US005383277A

United States Patent [19]

Shimoda et al.

[11] Patent Number: 5,383,277

[45] Date of Patent: Jan. 24, 1995

[54] WRITING APPARATUS AND METHOD

[75] Inventors: Mitsugi Shimoda; Hiroaki Hatori; Yoshinori Takubo; Takashi Masuda, all of Tokyo; Hirokazu Takada, Gunma, all of Japan

[73] Assignee: Max Co., Ltd., Tokyo, Japan

[21] Appl. No.: 29,399

[22] Filed: Mar. 10, 1993

[30] Foreign Application Priority Data

| | | | |
|---|---|---|---|
| Mar. 10, 1992 | [JP] | Japan | 4-021354[U] |
| Mar. 10, 1992 | [JP] | Japan | 4-021355[U] |
| Mar. 10, 1992 | [JP] | Japan | 4-021356[U] |
| Mar. 10, 1992 | [JP] | Japan | 4-021357[U] |
| Mar. 10, 1992 | [JP] | Japan | 4-086418 |
| Mar. 10, 1992 | [JP] | Japan | 4-086419 |
| Mar. 12, 1992 | [JP] | Japan | 4-021909 |

[51] Int. Cl.[6] ..... B43L 13/00

[52] U.S. Cl. ..... 33/18.1; 33/1 M

[58] Field of Search ..... 33/18.1, 18.2, 26, 27.01, 33/32.1, 32.2, 32.3, 1 M

[56] References Cited

U.S. PATENT DOCUMENTS

| | | | |
|---|---|---|---|
| 3,665,610 | 5/1972 | Schlau et al. | 33/18.1 |
| 4,315,371 | 2/1982 | Kotani et al. | 33/1 M |
| 4,356,632 | 11/1982 | Anderka | 33/18.1 |
| 4,756,086 | 7/1988 | Yajimi et al. | 33/1 M |
| 4,835,872 | 6/1989 | Alcantara Perez et al. | 33/18.1 |
| 5,012,584 | 5/1991 | Galan et al. | 33/1 M |
| 5,056,229 | 10/1991 | Carlson | 33/18.1 |

FOREIGN PATENT DOCUMENTS

| | | |
|---|---|---|
| 58-179699 | 10/1983 | Japan . |
| 623562 | 7/1984 | Japan . |
| 61-124744 | 8/1986 | Japan . |
| 61-171396 | 8/1986 | Japan . |
| 61-145692 | 9/1986 | Japan . |
| 63-128088 | 8/1988 | Japan . |
| 1148389 | 10/1989 | Japan . |

*Primary Examiner*—William A. Cuchlinski, Jr.
*Assistant Examiner*—G. Bradley Bennett
*Attorney, Agent, or Firm*—Cushman Darby & Cushman

[57] ABSTRACT

In order to reduce an impact noise which is made when a pen lifting rail (5) is swung up into contact with a pen support arm (4) in a writing apparatus wherein the arm is swung up and down by swinging the rail up and down, in the present invention, immediately before the pen lifting rail (5) being swung up by de-energizing a solenoid, which is energized to swing down the rail, comes into contact with the bottom of the pen support arm (4), the solenoid is instantaneously energized to slow down the upward swinging of the rail to reduce the impact noise.

20 Claims, 25 Drawing Sheets

FIG. 7

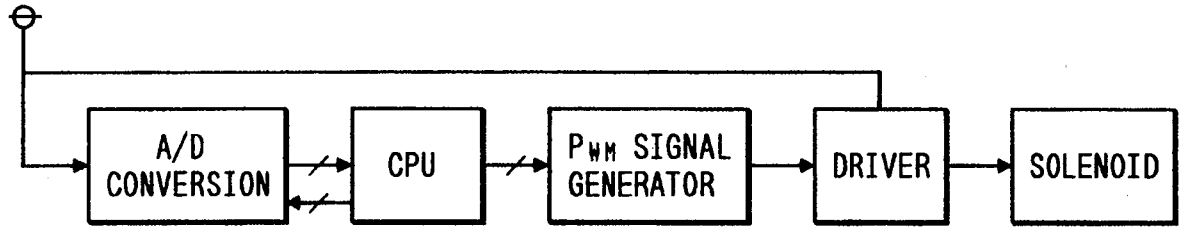

A/D CONVERSION : THE VOLTAGE $V_{MM}$ IS CONVERTED INTO A DIGITAL VALUE AT A PREDETERMINED INTERVAL ⟨ OR IN ACCORDANCE WITH CPU. ⟩ , AND IS OUTPUT INTO CPU.

$P_{WM}$ SIGNAL GENERATOR : $P_{WM}$⟨ PULSE MODULATION SIGNAL ⟩ IN ACCORDANCE WITH THE DIGITAL SIGNED CPU, IS OUTPUT INTO DRIVER.

DRIVER : THE CURRENT IS SUPPLIED FROM A POWER SOURCE ⟨ $V_{MM}$ ⟩ TO SOLENOID. THE VALUE OF CURRENT IS DECEIDED BY $P_{WM}$ SIGNAL.

SOLENOID : ACTUATOR FOR PEN-UP-DOWN.

FIG. 8

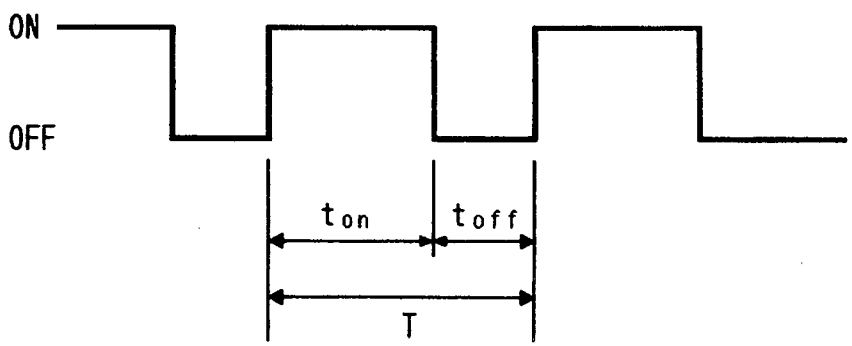

FIG. 10

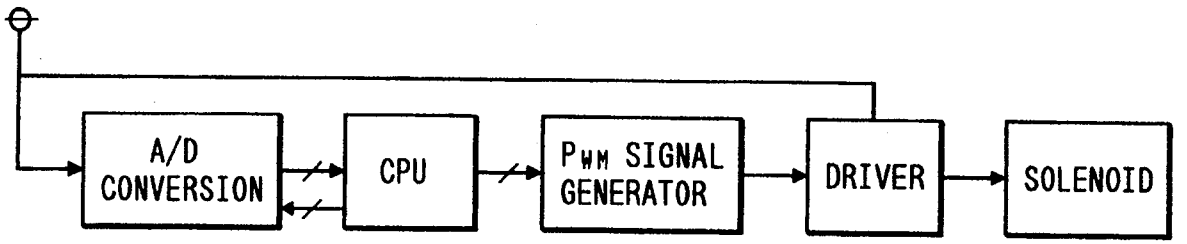

A/D CONVERSION : THE VOLTAGE $V_{MM}$ IS CONVERTED INTO A DIGITAL VALUE AT A PREDETERMINED INTERVAL ( OR IN ACCORDANCE WITH CPU. ) , AND IS OUTPUT INTO CPU.

$P_{WM}$ SIGNAL GENERATOR : $P_{WM}$( PULSE MODULATION SIGNAL ) IN ACCORDANCE WITH THE DIGITAL SIGNED CPU, IS OUTPUT INTO DRIVER.

DRIVER : THE CURRENT IS SUPPLIED FROM A POWER SOURCE ( $V_{MM}$ ) TO SOLENOID. THE VALUE OF CURRENT IS DECEIDED BY $P_{WM}$ SIGNAL.

SOLENOID : ACTUATOR FOR PEN-UP-DOWN.

FIG. 11

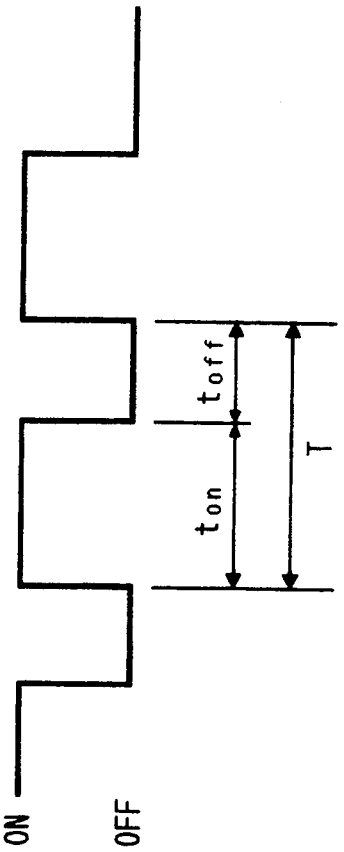

WRITING APPARATUS AND METHOD

BACKGROUND OF THE INVENTION

The present invention relates to a writing apparatus and method wherein a pen supporting arm holding a pen at the tip of the arm is moved along a horizontal x-axis and a horizontal Y-axis perpendicular to each other, and the rail is swung up to swing up the arm to move up the pen from the surface of writing paper and swung down to swing down the arm to move down the pen to the surface of the paper.

In a writing apparatus and method of such kind, a pen support arm which is moved over a prescribed area of a casing frame along a horizontal x-axis and a horizontal y-axis perpendicular to each other, is repeatedly swung up and down so that a pen held by the arm is repeatedly put into and out of contact with the surface of writing paper to write a character, a figure or the like thereon.

The apparatus includes a mechanism which is for repeatedly swinging the pen support arm up and down and has a pen lifting rail supported by the casing frame and disposed under the arm so that the rail can be swung up and down into and out of contact with the bottom of the arm to swing it up and down. As for the mechanism, an unpleasant impact noise is made every time the pen lifting rail is swung up into contact with the bottom of the pen support arm. This is a problem because the noise acts to deteriorate the efficiency of work in an office or the like.

To solve the problem, it was proposed in the Japanese Utility Model Application (OPI) No. 148389/89 (the term "OPI" as used herein means an "unexamined published application") that a sound absorber is attached to the pen lifting rail. Meanwhile, the impact noise consists of not only a noise made by the collision of the rail against the arm, but also noises caused at the portion of the mechanism due to the vibration of the entire mechanism, which results from the collision. The latter noises are higher in intensity than the former. Therefore, only attaching the sound absorber to the rail does not produce an effect to reduce the impact noise well. Besides, attaching the absorber to the rail results in increasing the number of the parts of the writing apparatus, the assembly work thereof and the cost of the apparatus, and is therefore not desirable.

In addition, in a conventional writing apparatus includes a mechanism which is for repeatedly swinging the pen support arm up and down and has a pen lifting rail supported by the casing frame and disposed under the arm so that the rail can be swung up and down into and out of contact with the bottom of the arm to swing it up and down. In the mechanism, the pen lifting rail is supported in a prescribed location by the casing frame so that the rail can be swung up and down. For that reason, the distance h1 between the pen support arm 4 and the pen lifting rail 5 in the case that the pen held by the arm at the tip thereof is located nearest the frame as shown in FIG. 12(*a*) differs from that h2 between the arm and the rail in the case that the pen is located farthest from the frame as shown in FIG. 12(*b*). Therefore, the speed of the upward swinging of the rail 5 at the time of the contact thereof into the arm 4 in the former case differs from that in the latter case. As a result, the impact of the rail 5 on the arm 4 in the former case is heavier than that in the latter case. Since the arm 4 bounces as a whole when receiving the impact, the next writing action of the apparatus cannot properly be performed until the bounce disappears. If the arm 4 were swung down during the bounce in order to perform the next writing action, the pen would be vibrated up and down to have its tip come into contact with the surface of the writing paper to give ink to an unnecessary part of the surface. For that reason, the time point at which the rail swung up after the previous writing action of the apparatus is swung down to swing down the arm to move down the pen to perform the next writing action is preset depending on the time which it takes for the bounce of the arm to disappear in the latter case that the pen is located farthest from the casing frame. As a result, in the former case, the pen is not moved down until the lapse of the time although the pen can be moved down in the time. In other words, a waiting time longer than a necessary length is spent so that the efficiency of writing by the apparatus is deteriorated. This is a problem.

Further, in a conventional mechanism for moving a pen up and down in a writing apparatus of such kind, a pen lifting rail for swinging up and down a pen support arm holding the pen at the tip of the arm is disposed near the front edge of a casing frame and supported at both the ends of the rail near the right and left sides of the frame so that the rail can be swung up and down in a prescribed range to come into and out of contact with the bottom of the arm to swing it up and down to move the pen up and down. The length of the vertical movement of the pen depends on the location thereof along a horizontal y-axis or depends on whether the pen is located near or away from the casing frame. When the pen held by the arm at the tip thereof is located near the frame, the rail is swung up and down into and out of contact with the arm near the tip thereof to swing the arm up and down to move the pen up and down. When the pen is located far from the frame, the rail is swung up and down into and out of contact with the arm near the butt thereof to swing the arm up and down to move the pen up and down. Since the length of the vertical swing of the rail is always constant, the length of the vertical movement of the pen in the case that the arm holding the pen at the tip of the arm is swung up and down by the rail located near the butt of the arm is larger than that in the case that the arm is swung up and down by the rail located near the tip of the arm. In the former case, the pen bounces up and down on the surface of writing paper so as to much deteriorate the quality of writing thereon with the pen as it falls into contact with the surface of the paper. Since the length of the vertical movement of the pen is smaller in the latter case, the tip of the pen is likely to do damage such as tear to the paper if it has a projection for the pen to engage with. To proceed from a step of writing to a next step of writing, the pen support arm is once swung up, then horizontally moved, and thereafter swung down. The time which it takes to proceed from the preceding step of writing to the next step of writing depends much on the location of the pen along the y-axis. Since the preset length for the time needs to be equalized to the maximum of the time, the efficiency of writing by the apparatus is low.

Furthermore, in a conventional writing apparatus including an x-axis rail supported by a casing frame so as to be movable relative to the frame along a y-axis, and a pen support arm holding a pen at the tip of the arm and supported by the rail so as to be movable relative to the rail along a horizontal x-axis perpendicular to the y-axis, the rail needs to be precisely moved along the y-axis. In a control mechanism for the precise movement of the rail along the y-axis, the rail is secured at both the ends thereof to timing belts extending along the y-axis, and one of the belts is revolved to move the rail along the y-axis. The timing belts are engaged at both the ends thereof with toothed pulleys supported by the casing frame. Although the mechanism does not have a problem in the normal writing operation of the apparatus, the mechanism has a problem that when the pen support arm is forcibly pulled out much from the casing frame in order to attach the pen to the arm, one of the timing belts is pulled more strongly than the other if the arm is off the center line of the right-to-left width of the frame. The tooth of the timing belt pulled more strongly than the other is disengaged from one tooth of a toothed pulley and then engaged with another tooth thereof so that the position of the belt deviates from that of the other belt by one pitch to result in moving the arm on wrong tracks along the x-axis and the y-axis to make the writing operation of the apparatus improper.

SUMMARY OF THE INVENTION

The present invention was made in order to solve the problems described above. Accordingly, it is an object of a first aspect of the invention to provide a method of adequately reducing an impact noise which is made when the pen lifting rail of a writing apparatus is swung up into contact with the bottom of the pen support arm thereof to swing it up.

The writing apparatus on which the impact noise is reduced in the method provided in accordance with the first aspect of the present invention includes an x-axis rail supported by a casing frame so as to be movable relative to the frame along a horizontal y-axis; an x-axis carriage supported by the rail so as to be movable relative to the rail along a horizontal x-axis perpendicular to the y-axis; the pen support arm which is supported at the butt thereof by the carriage so as to be swingable up and down and supports a pen at the tip of the arm; the pen lifting rail which extends in parallel with the x-axis rail and which is supported so as to be capable of being swung up into contact with the bottom of the arm to move up the pen from the surface of writing paper and swung down out of contact with the bottom of the arm to let the pen fall into contact with the surface of the paper, and is always urged in such a direction so as to be swung up; and a solenoid which is energized to swing down the pen lifting rail. The method is characterized in that immediately before the pen lifting rail being swung up by de-energizing the solenoid comes into contact with the bottom of the pen support arm, the solenoid is instantaneously energized to slow down the upward swinging of the lifting rail.

It is preferable that the time, quantity and duration of the instantaneous energizing of the solenoid are modulated depending on the location of the pen or the x-axis rail along the y-axis.

In the method provided in accordance with the first aspect of the present invention, when the pen lifting rail being swung up by de-energizing the solenoid to swing up pen support arm, the solenoid is instantaneously energized to apply a downward swinging force to the rail so that the force acts as a braking force to counter the upward swinging force on the rail to sharply slow down the upward swinging thereof to diminish the impact of the rail on the bottom of the arm. For that reason, the impact noise is much reduced.

The time, quantity and duration of the instantaneous energizing of the solenoid can be modulated depending on the location of the pen or the x-axis rail along the y-axis, to always reduce the impact noise well, regardless of the inaccuracy of assembly of the parts of the writing apparatus and the location of the pen or the rail along the y-axis.

In addition, it is an object of a second aspect of the present invention to provide a method of moving down the pen of a writing apparatus without spending an unnecessary waiting time, to enhance the efficiency of writing by the apparatus.

The method provided in accordance with the second aspect of the present invention for the writing apparatus including an X-axis rail supported by a casing frame so as to be movable relative to said frame along a horizontal y-axis; an x-axis carriage supported by the rail so as to be movable relative to the rail along a horizontal x-axis perpendicular to the y-axis; a pen support arm which is supported at the butt thereof by the carriage so as to be swingable up and down, and supports the pen at the tip of said arm; a pen lifting rail which extends in parallel with the x-axis rail and which is supported so as to be capable of being swung up into contact with the bottom of the arm to move up the pen from the surface of writing paper and swung down out of contact with the bottom of the arm to let the pen fall into contact with the surface of the paper, and is always urged in such a direction as to be swung up; and a solenoid which is energized to swing down the pen lifting rail. The method is characterized in that the time, quantity and duration of the energizing of the solenoid, which is performed to swing down the pen lifting rail after the solenoid is de-energized to swing up the rail, are modulated depending on the location of the pen or the x-axis rail along the y-axis.

It is preferable that the solenoid is supplied with an electrical current constant deposit the fluctuation in the voltage of a power supply for the solenoid.

In the method provided in accordance with the second aspect of the present invention, the time, quantity and duration of the energizing of the solenoid, which is performed to swing down the pen lifting rail after the solenoid is de-energized to swing up the rail, are modulated depending on the location of the pen or the x-axis rail along the y-axis, so that if the pen bounces due to the contact of the pen lifting rail with the pen support arm, the writing operation of the apparatus is started at the time modulated depending on the quantity of the bounce. For that reason, the writing operation can be started always at an optimal time wherever the pen or the arm is located. In other words, the pen can be moved down without spending the unnecessary waiting time as done in the prior art. The time from the preceding step of writing to the succeeding step of writing by the apparatus can thus be shortened to enhance the efficiency of the writing operation thereof.

If the solenoid is supplied with the electrical current constant despite the fluctuation in the voltage of the power supply for the solenoid, the pen or the pen support arm is prevented from making an unnecessary bounce.

A mechanism or method in accordance with the first or second aspect may be characterized in that the spring is engaged at one end thereof with the pen lifting rail and at the other end of the spring with an engagement portion provided on the casing frame; and the location of the engaged end of the spring on the lifting rail or the engagement-portion can be modulated in the longitudinal direction of the spring.

In the mechanism provided in accordance with the present invention, immediately before the pen lifting rail being swung up by de-energizing the solenoid comes into contact with the bottom of the pen support arm, the solenoid is instantaneously energized to apply a downward swinging force to the rail so that the force acts as a braking force to counter the upward swinging force of the helical torsion spring to sharply slow down the upward swinging of the rail to diminish the impact of the rail on the arm. For that reason, the noise of the impact is much reduced.

The location of the engaged end of the spring for swinging up the pen lifting rail can be modulated in the longitudinal direction of the spring by altering the location of the engagement portion, to preset the upward swinging force of the spring. For that reason, if the dimensions or/and assembly of the components of the writing apparatus are inaccurate, the stiffness of the spring is not equal to a prescribed value or/and the spring is fatigued to alter the upward swinging force thereof, the location of the engagement portion is changed to preset the upward swinging force of the spring to swing up the rail into contact with the pen support arm always the prescribed time after the de-energizing of the solenoid so as to heighten the noise reduction effect of the mechanism.

Further, it is an object of a third aspect of the present invention to provide a mechanism for moving a pen up and down in such a manner that the length of the vertical swinging of a pen support arm holding the pen is always constant wherever the pen is located along a horizontal y-axis.

The mechanism provided in accordance with the third aspect of the present invention is for moving the pen up and down in writing apparatus including an x-axis rail supported at both the ends thereof by a pair of y-axis carriages which are simultaneously moved relative to a casing frame along the horizontal y-axis; an x-axis carriage supported by the rail so as to be movable relative to the rail along a horizontal x-axis perpendicular to the y-axis; the pen support arm which is supported at the butt thereof by the x-axis carriage so as to be swingable up and down, and supports the pen at the tip of the arm; a pen lifting rail which extends in parallel with the x-axis rail and which is supported to be capable of being swung up into contact with the bottom of the arm to move up the pen from the surface of writing paper and swung down out of contact with the bottom of the arm to let the pen fall into contact with the surface of the paper, and is always urged in such a direction as to be swung up; a solenoid which is energized to swing down the pen lifting rail; a means for moving the y-axis carriages along the y-axis; and a means for moving the x-axis carriage along the x-axis. The mechanism is characterized in that the pen lifting rail is supported at both the ends thereof in a swingable manner by the y-axis carriages or members coupled thereto; a jut extends from one end of the lifting rail along the x-axis, and is located away from the axis of the swinging of the lifting rail; and an operating member is supported by the casing frame, and extends along the total length of the movement of the x-axis rail along the y-axis, so that the operating member can be swung up and down to move the jut up and down.

In the mechanism provided in accordance with the third aspect of the present invention, the solenoid is de-energized and energized to swing the pen lifting rail up and down to swing the pen support arm up and down to move the pen up and down. Since the lifting rail is supported together with the x-axis rail by the y-axis carriages or the members coupled thereto, both the rails are moved together along the y-axis. For that reason, the lifting rail always comes into contact with the same portion of the arm so that the length of the vertical swinging of the arm due to the swinging of the rail is always constant. As a result, the length is not made excessively large to cause the pen to bounce to deteriorate the quality of writing with it, and is nor made excessively small to cause the pen to engage with the writing paper to damage it. Although the arm needs to be swung up, then horizontally moved and thereafter swung down in proceeding from a step of writing to another step of writing, the time which it takes to perform the proceeding is always constant wherever the pen is located along the x-axis and the y-axis. For that reason, the writing operation of the apparatus is efficient.

Furthermore, it is an object of a fourth aspect of the present invention to provide a mechanism for controlling the movement of an x-axis rail along a horizontal y-axis to move the rail precisely in parallel with the axis.

The mechanism provided in accordance with the fourth aspect of the present invention is for controlling the movement of the x-axis rail along a horizontal y-axis in a writing apparatus including the rail supported by a casing frame so as to be movable relative to the frame along the y-axis; an x-axis carriage supported by the rail so as to be movable relative to the rail along a horizontal x-axis perpendicular to the y-axis; and a pen support arm supported at the butt thereof by the carriage and holding a pen at the tip of the arm. The mechanism is characterized in that rack rails are provided on the casing frame near the right and left ends of the x-axis rails, and extend along the y-axis; and pinions are provided at the right and left ends of the x-axis rail and engaged with the rack rails so that the pinions roll thereon in conjunction with each other.

It is preferable that the racks of the rack rails face down. It is also preferable that the teeth of each of the pinions are constituted by a series of teeth and another series of teeth having a positional difference of half pitch from the former, and the teeth of each of the racks of the rack rails are constituted by a series of teeth and another series of teeth having a positional difference of half pitch from the former, correspondingly to the pinion.

The mechanism provided in accordance with the fourth aspect of the present invention functions so that when the x-axis rail and the pen support arm are moved along the y-axis and the x-axis, respectively, to write a character, a figure or the like on the surface of writing paper, the pinions provided at the right and left ends of the x-axis rail roll on the rack rails simultaneously with the movement of the x-axis rail as the pinions remain engaged with the rack rails. Since the pinions roll in conjunction with each other, they are simultaneously rotated in the same direction by the same number of rounds so that even if the pen support arm is forcibly pulled out much from the casing frame along the y-axis, the positions of the pinions do not deviate from each other. For that reason, the x-axis rail is always precisely moved in parallel with the y-axis so that the writing of the character, the figure or the like is not made improper.

In the teeth of the racks of the rack rails face down, dust or the like is less likely to come to cling to the teeth, so that the engagement of the racks and the pinions is kept smooth to stabilize the quality of the writing. If the teeth of each of the pinions and the racks of the rack rails are constituted by the two series of teeth having the positional difference of half pitch from each other, the pinions and the racks do not undergo backlash at the beginning of the reverse revolution of a timing belt, so that the quality of the writing is more improved.

However, the mechanism according to the present invention may be characterized in that the y-axis carriage or the x-axis carriage has an attaching portion to which the timing belt is attached at the ends thereof; the attaching portion has pairs of upper and lower guide juts located at both the ends of the portion and extending rectangularly across the longitudinal direction of the belt so that the distance between the juts of each pair is nearly equal to the thickness of each bent-back and folded end portion of said belt, which is formed by bending the belt back and then folding it at the end thereof; the attaching portion also has an engagement pin located inside one of the pairs of upper and lower guide juts and extending along them; both the bent-back and folded end portions of the belt are laid through between the pairs of upper and lower guide juts, respectively; one of the end portions is engaged with the engagement pin; and a compressed spring for controlling the tension of the belt is wound on the other of the end portions, located inside the other of the pairs of upper and lower guide juts, and engaged with the inner sides thereof at the end of the spring.

In the mechanism provided in accordance with the present invention, the timing belt is bent back and then folded at both the ends thereof so that the belt has both the bent-back and folded end portions, one of which is laid through between one of the pairs of upper and lower guide juts and engaged with the engagement pin at the end of the portion. Since the teeth of the mutually overlaid parts of the above-mentioned one of the end portions are engaged with each other and the portion is fitted in between the guide juts to leave almost no clearance between them, the mutually overlaid parts do not deviate from each other. The compressed spring is wound on the other of the pairs of upper and lower guide juts, and inserted at the other end of the spring in between the mutually overlaid parts of the other of the bent-back and folded end portions of the belt at the other end of the spring not to come off the end portion. The other of the end portions is laid through between the other of the pairs of upper and lower guide juts so that the compressed spring is located inside the juts and engaged with the inner sides thereof at the former end of the spring. Thus, without using an attaching metal or a tool, the timing belt can be easily and securely attached at the ends thereof to the attaching portion of the y-axis carriage or the x-axis carriage by the simple work in which the belt is bent back and folded at both the ends thereof, one of the bent-back and folded end portions of the belt is engaged with the engagement pin, the compressed spring is wound on the other of the end portions, and both the end portions are laid through between both the pairs of upper and lower guide juts respectively.

In addition, a pen support arm according to the present invention may be characterized in that it is made of a metal frame, and a synthetic resin portion which extends in the same longitudinal direction as the metal frame and whose bottom is lower than that of the metal frame; the resin portion has a slide contact surface which slides on the rail at least when the apparatus is in writing operation; the bottom of the arm has an upper surface between the slide contact surface and the pen holding portion so that the upper surface is continuous to a wall continuous to the slide contact surface, and the upper surface faces the rail across a gap when the pen is moved to the rest as the apparatus is out of writing operation; and the arm has an engagement bump formed at the wall so as to be engaged with the rail to guide the arm to move it up.

When the pen held by the pen support arm provided in accordance with the present invention is to be moved to the pen rest as the writing apparatus is out of writing operation, the solenoid is de-energized to swing up the pen lifting rail to swing up the arm to move up the pen, and the arm is then moved with an x-axis rail beyond the range of writing movement thereof along the y-axis so that the slide contact surface of the synthetic resin portion of the arm slides on the pen lifting rail, and the engagement bump is then engaged with the lifting rail to have the guide slopes of the bump slide on the lifting rail to guide the arm to move it up. After the bump of the arm is thus moved beyond the pen lifting rail, the pen reaches the pen rest. At that time, the upper surface of the bottom of the arm faces the lifting rail across the small gap so that the tip of the pen comes into good tight contact with the rest due to the weight of the pen. As a result, the tip of the pen is kept out of contact with air so that ink on the tip is well prevented from drying. Since the solenoid remains de-energized in that case, it does not consume electricity unnecessarily while the apparatus is out of writing operation. Since the engagement bump and the synthetic resin portion are integrally formed together, it is not necessary to take time and trouble in particular to provide such a bump. Desirable effects are thus produced by the present invention.

BRIEF DESCRIPTION OF THE DRAWINGS

FIG. 7 is a block diagram of a circuit for causing a constant electrical current to flow through the solenoid despite the fluctuation in the voltage of a power supply therefor.

FIG. 8 is a graph indicative of the wave form of a pulse modulation signal.

FIG. 10 is a block diagram of a circuit for causing a constant electrical current to flow through the solenoid, despite the fluctuation of the voltage of a power supply therefor.

FIG. 11 is a graph indicative of the wave form of a pulse modulation signal.

DETAILED DESCRIPTION OF THE PREFERRED EMBODIMENTS

Figure 1:
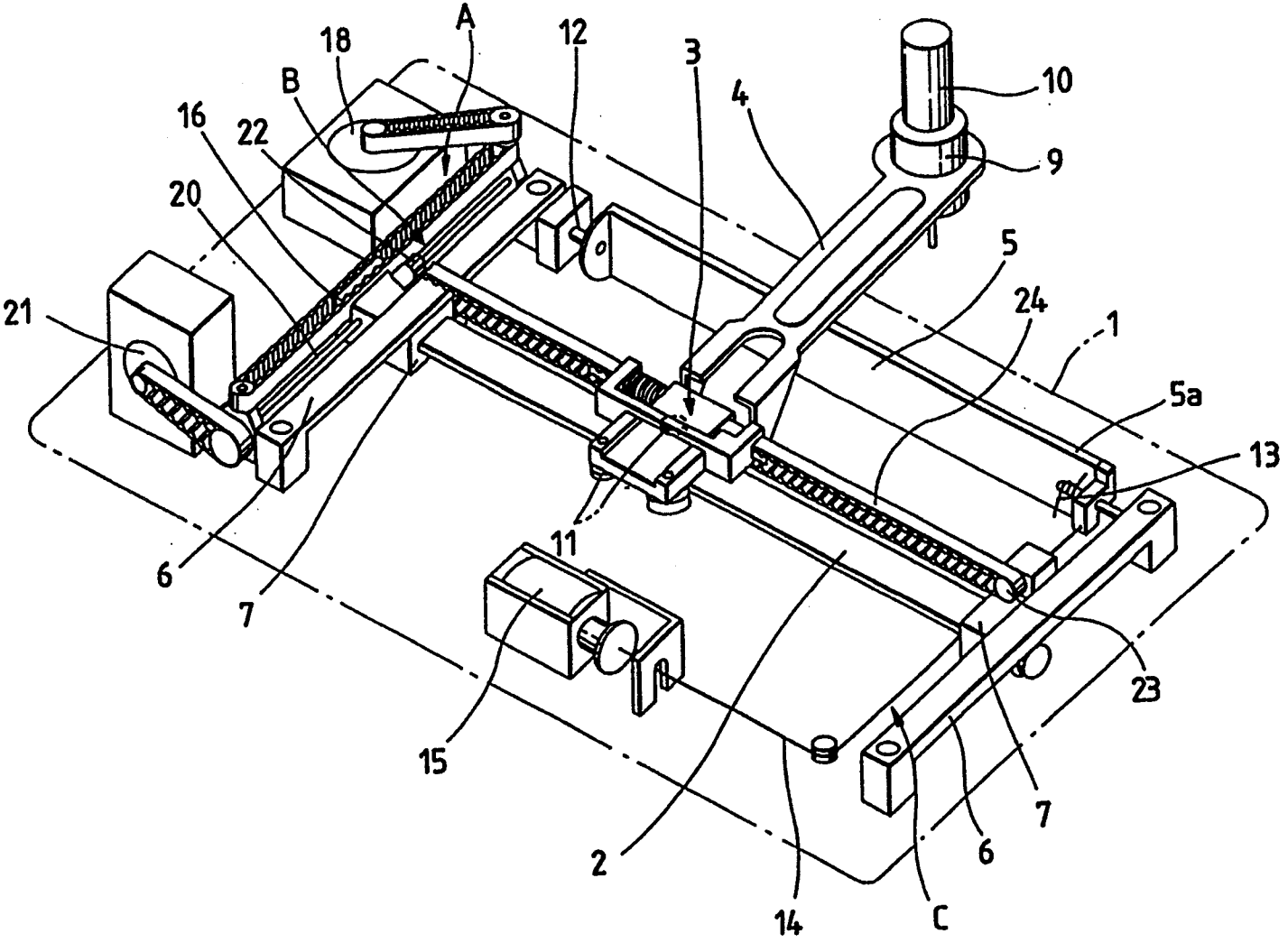
FIG. 1 is a perspective view of a writing apparatus according to a first embodiment of the present invention.

A first embodiment of the present invention is hereafter described with reference to the drawings attached hereto. The embodiment is a method of reducing an impact noise which is made when the pen lifting rail of a writing apparatus shown in FIG. 1 is swung up into contact with the bottom of the pen support arm thereof to swing it up.

The writing apparatus includes a casing frame 1; an x-axis rail 2 supported by the frame so as to be movable relative to the frame along a horizontal y-axis; an x-axis carriage 3 supported by the rail so as to be movable relative to the rail along a horizontal x-axis perpendicular to the y-axis; the pen support arm 4 which is supported at the butt thereof with a hinge by the carriage so as to be swingable up and down, and supports a pen 10 at the tip of the arm; the pen lifting rail 5 for swinging the arm up and down to move the pen up and down; a drive mechanism A for moving the arm with the x-axis rail along the y-axis; a drive mechanism B for moving the arm with the carriage along the x-axis; a drive mechanism C for swinging the pen lifting rail up and down to swing the arm up and down; and a controller for regulating the drive mechanisms. The apparatus also includes guide rails 6 provided near the right and left sides of the casing frame 1 and extending in parallel with each other along the y-axis; y-axis carriages 7 secured to the x-axis rail 2 at both the ends thereof so as to be movable along the guide rails; a pen holder 9 attached to the pen support arm 4 at the tip thereof; the pen 10 removably screw-engaged with the holder; and rollers 11 attached to the x-axis carriage 3 and pinching the x-axis rail 2 at both the side edges thereof so that the carriage can be moved with the rollers on the rail along the longitudinal direction thereof.

The pen lifting rail 5 is a slender plate extending near the front edge of the casing frame 1 in parallel with the x-axis rail 2 and supported at the centers of both the end portions of the plate with pins 12 by the frame so that the plate can be swung up and down to make both the main surfaces thereof nearly vertical and horizontal and move one side edge 5*a* of the plate up and down.

Figure 2A:
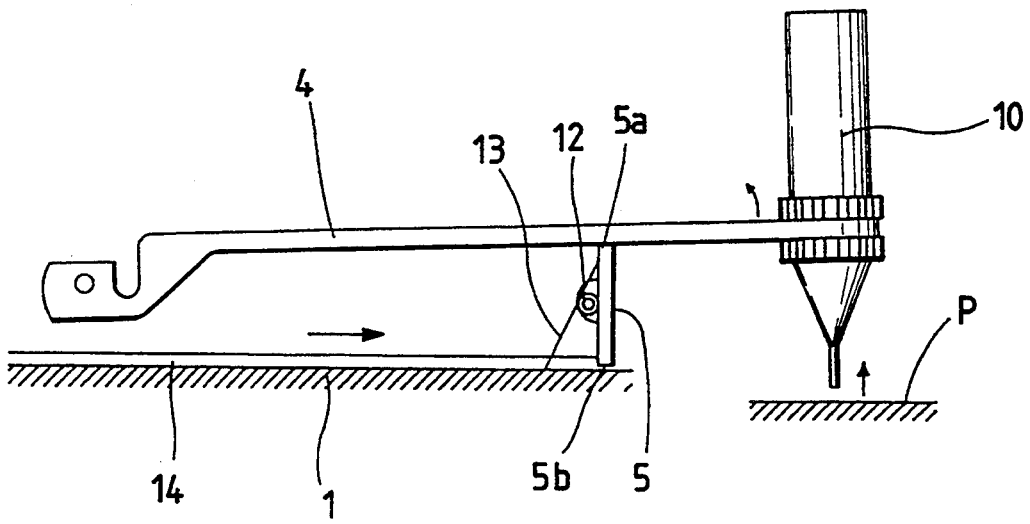
FIGS. 2(*a*) and 2(*b*) are views of the apparatus to illustrate the operation of a pen lifting rail.
Figure 2B:
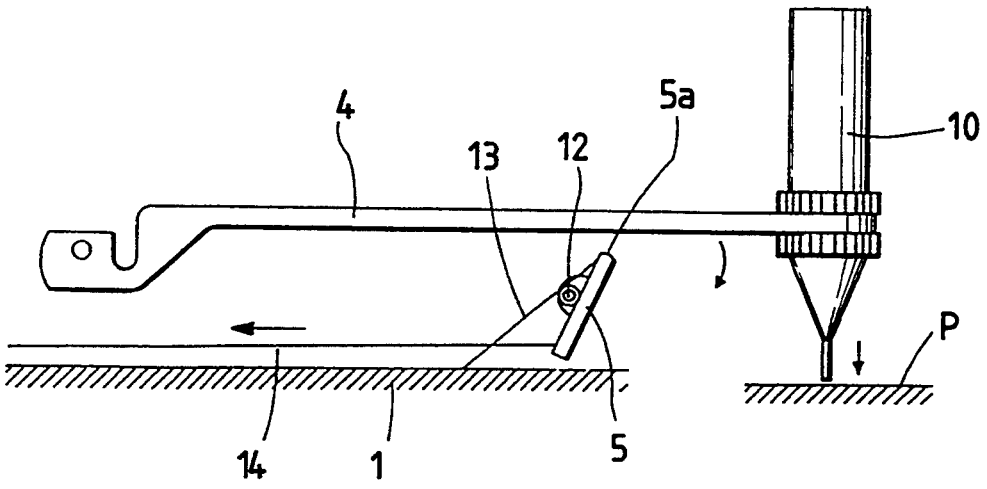

The drive mechanism C for swinging the pen lifting rail 5 up and down to swing the pen support arm 4 up and down includes a helical torsion spring 13 urging the rail at one main surface thereof in such a direction as to normally move up the side edge 5*a* of the rail. A string 14 coupled at one end thereof to the rail at the other side edge 5*b* thereof, and a solenoid 15 to which the string is coupled at the other end thereof. When the solenoid 15 is de-energized, the rail 5 is swung up by the force of the spring 13 to make both the main surfaces of the rail nearly vertical and move up the side edge 5*a* thereof so that the edge comes into contact with the bottom of the pen support arm 4 to move up the pen 10 from the surface P of writing paper, as shown in FIG. 2(*a*). When the solenoid 15 is energized, the string 14 is pulled by the solenoid to swing down the rail 5 to make both the main surfaces thereof nearly horizontal and move down the side edge 5*a* of the rail so that the edge comes out of contact with the arm 4 to let it gravitate to move down the pen 10 into contact with the surface P of the writing paper, as shown in FIG. 2(*b*).

The drive mechanism A for moving the pen support arm 4 along the y-axis is provided on the casing frame 1, and includes the x-axis rail 2, the y-axis carriages 7 secured to the rail and movable along the y-axis, a timing belt 16 extending along the y-axis and coupled to one of the carriages, and a step motor 18 for revolving the belt to move the rail along the y-axis. When the step motor 18 is put in action, the timing belt 16 is revolved to move the carriages 7 and the rail 2 together along the y-axis to move the pen support arm 4 along the axis.

The drive mechanism B for moving the pen support arm 4 along the x-axis is provided on the casing frame 1, and includes the x-axis carriage 3, a rotary shaft 20 provided under the timing belt 16 and extending along the y-axis, a step motor 21 connected to the shaft to rotate it to move the carriage along the x-axis, a toothed pulley 22 supported by one of the y-axis carriages 7 so as to be rotatable together with the shaft and slidable thereon, another toothed pulley 23 supported by the other of the y-axis carriages, and a timing belt 24 engaged with both the pulleys and secured to the x-axis carriage. When the step motor 21 is put in action, the rotary shaft 20 is rotated to revolve the timing belt 24 through the action of the toothed pulleys 22 and 23 to move the x-axis carriage 3 along the x-axis to move the pen support arm 4 along the axis.

The step motors 18 and 21 are connected to the controller made of a microcomputer but not shown in the drawings. Commands are sent from the controller in order to rotate the step motors 18 and 21 by prescribed quantities. The y-axis carriage 7 supporting the pulley 22 is slidable on the rotary shaft 20.

When a character, a figure or the like is to be written on the surface P of the writing paper by the writing apparatus, the pen support arm 4 is swung down to put the pen 10 into contact with the surface of the paper and then moved along the x-axis and the y-axis to perform a step of writing with the pen on the surface of the paper, and is thereafter swung up, moved along the x-axis and the y-axis, swung down again to put the pen into contact with the surface of the paper and then moved along the axes to perform another step of writing with the pen on the surface of the paper. A number of such steps of writing are thus performed repeatedly with the pen 10 to write the character, the figure or the like on the surface P of the paper.

To swing the pen support arm 4 up and down to move the pen 10 up and down, the pen lifting rail 5 is swung up and down by de-energizing and energizing the solenoid 15 under the regulatory action of the controller. The controller is preset to instantaneously energize the solenoid 15 immediately before the rail 5 being swung up by de-energizing the solenoid comes into contact with the bottom of the arm 4. Because of the de-energizing, only the upward swinging force of the helical torsion spring 13 is applied to the rail 5 so that it is swung up to swing up the arm 4, as shown in FIG. 2(*a*). Because of the instantaneous energizing during the upward swinging of the rail 5, a downward swinging force is also applied to the rail by the solenoid 15 so that the force acts as a braking force to counter the upward swinging force of the spring 13 to sharply slow down the upward swinging of the rail to diminish the impact thereof on the bottom of the arm 4, thus reducing the impact noise.

Figure 3A:
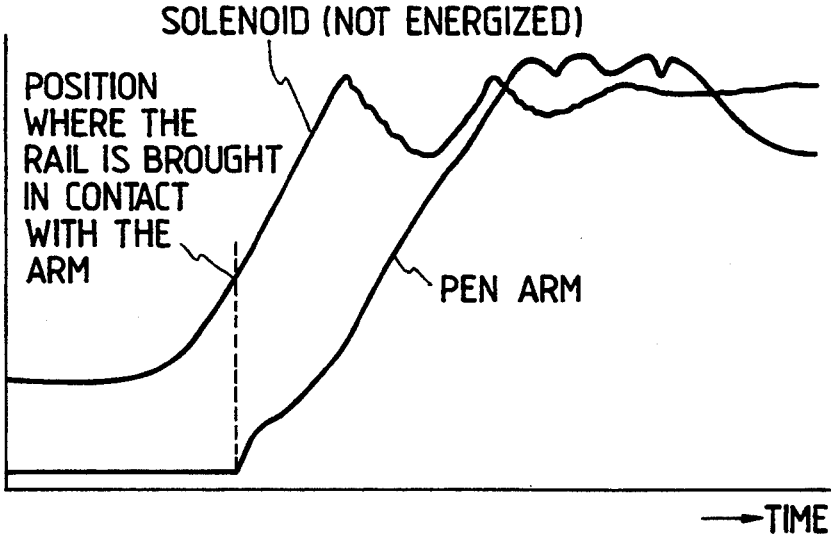
FIGS. 3(*a*) and 3(*b*) are graphs to illustrate the operation of the rail with and without the instantaneous energizing of a solenoid.
Figure 3B:
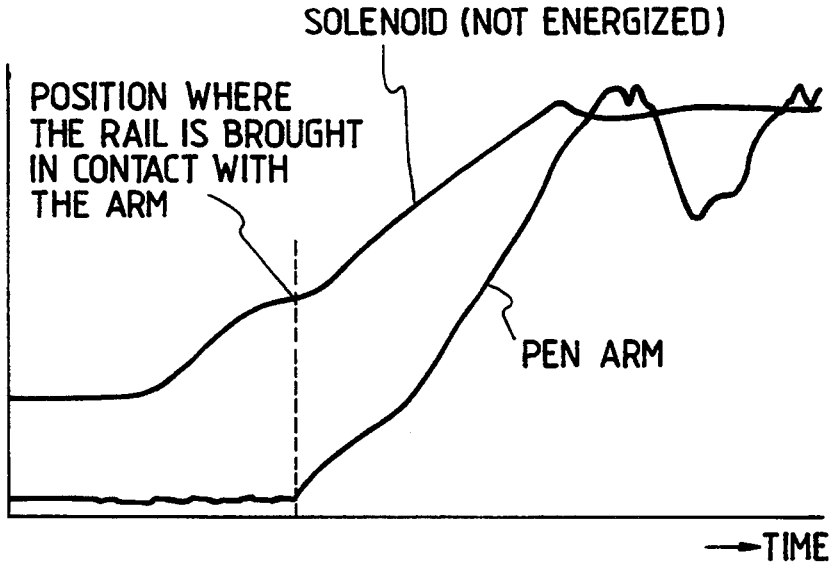

FIG. 3(*a*) is a graph showing the case that the instantaneous energizing is not performed. FIG. 3(*b*) is a graph showing the case that the instantaneous energizing is performed. FIG. 3(*b*) shows that the gradient of a line indicative of the upward swinging of the pen lifting rail 5 decreases at the time of the instantaneous energizing. The decrease means the slowdown of the upward swinging. The rail 5 is caused to come into contact with the pen support arm 4 at or near the time of the slowdown so that the impact noise is much reduced.

Figure 4A:
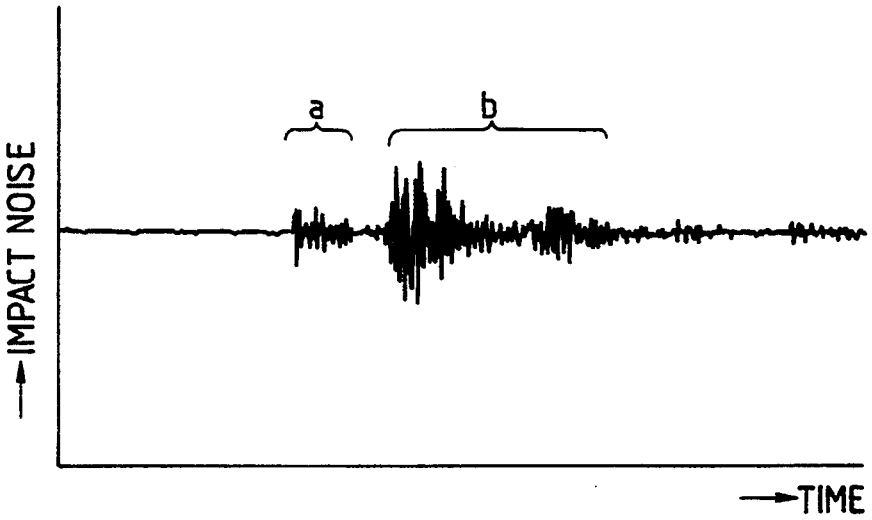
FIGS. 4(*a*) and 4(*b*) are graphs indicative of impact noises made with and without the instantaneous energizing of the solenoid.
Figure 4B:
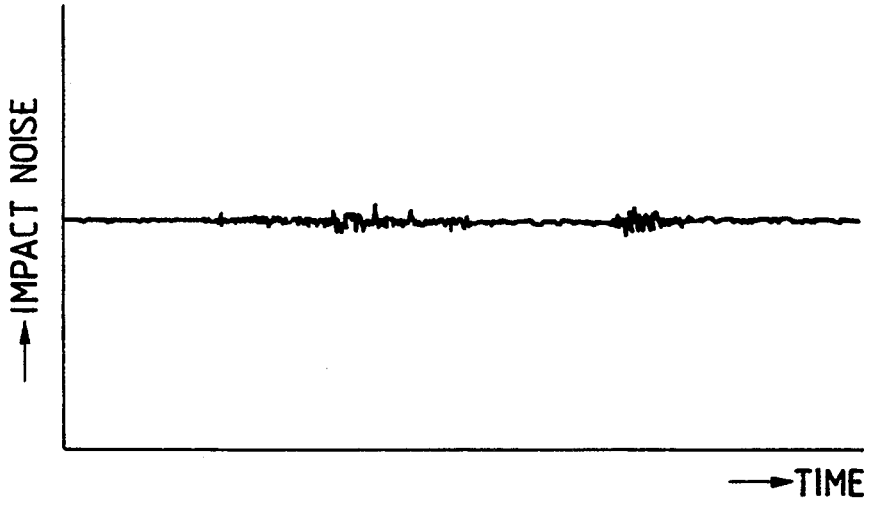

FIG. 4(*a*) is a graph showing the impact noise not reduced. FIG. 4(*b*) is a graph showing the impact noise reduced. In an experiment on the method, the impact noise was reduced much enough not to make people at work in an office feel unpleasant. Therefore, it is clear that the impact noise is reduced well enough by slowing down the upward swinging of the pen lifting rail 5 in the method. A portion a of the former graph indicates the impact noise which is made at the time of the collision of the rail 5 against the pen support arm 4. Another portion b of the graph indicates a noise which is made because of the vibration of the x-axis carriage 3, the butt portion of the arm 4 and other parts of the apparatus, which results from the collision. Although the latter noise is more grave than the impact noise, the latter is greatly reduced as a result of the reduction of the former.

Figure 5A:
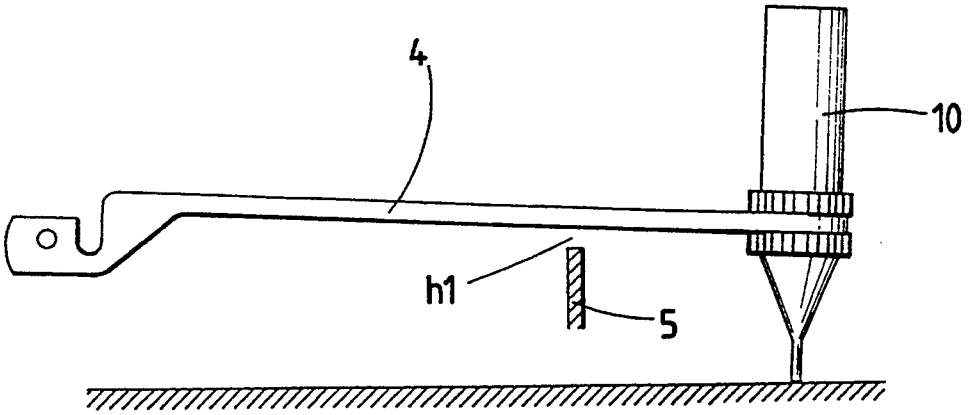
FIGS. 5(*a*) and 5(*b*) are views of the apparatus to illustrate the positional relationship between a pen support arm and the rail with the different locations of a pen along a y-axis.
Figure 5B:
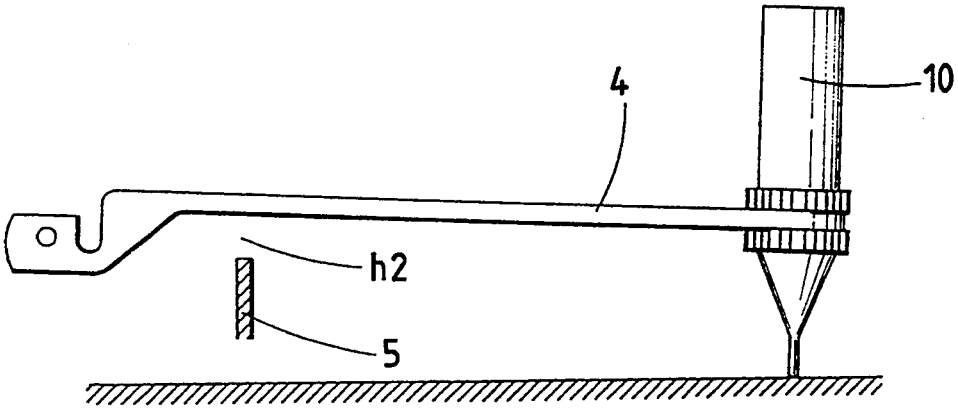
Figure 6:
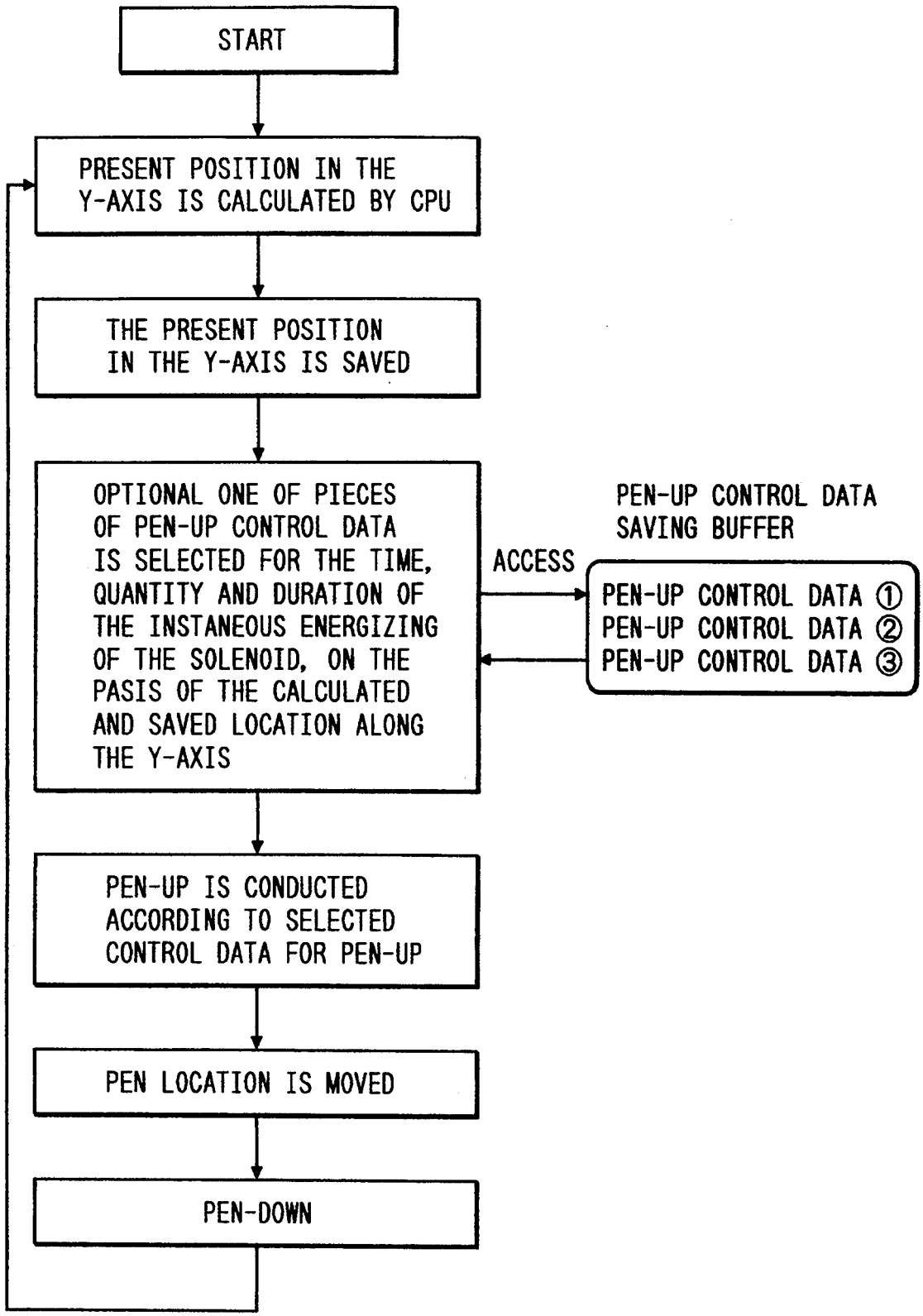
FIG. 6 is a flow chart for determining the time, quantity and duration of the instantaneous energizing of the solenoid.

It is preferable that the time, quantity and duration of the instantaneous energizing of the solenoid 15 under the regulatory action of the controller are modulated depending on the location of the pen 10 along the y-axis. Since the distance h1 between the pen support arm 4 and the pen lifting rail 5 in the case that the pen 10 is located nearest the casing frame 1 and has the tip on the surface P of the writing paper as shown in FIG. 5(*a*) differs from the h2 between the arm and the rail in the case that the pen is located farthest from the frame and has the tip on the surface of the paper as shown in FIG. 5(*b*), the time which is takes to swing up the rail into contact with the arm 4 after the start of the de-energizing of the solenoid 15 in the former case differs from that which it takes to swing up the rail into contact with the arm after the start of the de-energizing of the solenoid in the latter case. For that reason, the instantaneous energizing of the solenoid 15 needs to be performed relatively early in the former case but relatively late in the latter case, in consideration of the possible inaccuracy of assembly of the pen 10 and other parts of the writing apparatus as well as the time to be taken. If the time and quantity of the instantaneous energizing were unchanged for both the cases, the time would be good but the upward swinging of the rail 5 after the contact thereof into the arm 4 would be delayed in the former case, and the time would be so early in the latter case as to lengthen the time which it took to swing up the rail into contact with the arm. Therefore, it is preferable that the time, quantity and duration of the instantaneous energizing are determined depending on the location of the pen 10 or the x-axis rail 2 along the y-axis. For the determination, the location of the pen 10 or the rail 2 along the y-axis is calculated by the central processing unit of the controller so that optimal one of pieces of pen lifting rail control data is selected from the time, quantity and duration of the instantaneous energizing, on the basis of the calculated location to perform the instantaneous energizing, as shown in FIG. 6 which is a flow chart. The optimal data is selected on the basis of the y-axis ordinate Ty of the calculated location as follows:

Data (1) if (Ty) < Y1
Data (2) if Y1 = or < (Ty) < Y2
Data (3) if Y2 = or < (Ty) < Y3
.
.
.
.

The time, quantity and duration of the instantaneous energizing of the solenoid 15 can thus be optimized depending on the location of the pen 10 or the x-axis rail 2 along the y-axis so as to slow down the upward swinging of the pen lifting rail 5 at an optimal time for an optimal duration.

Since the slowdown is affected by the fluctuation in a driving voltage for energizing the solenoid 15, it is preferable that the fluctuation is monitored by the central processing unit of the controller to cause a constant electrical current to flow through the solenoid to energize it, despite the fluctuation, as shown in FIG. 7 which is a block diagram. Processing with the block diagram is described from now on. The voltage $V_{MM}$ of a power supply for the solenoid 15 is first converted into a digital value in accordance with a formula $D_V=A_D(V_{MM})$ wherein $D_V$ is a parameter. Pulse modulation signal data prepared in a program or a table is subjected to a converting calculation in accordance with a formula $P=P_{WM}D_V)$ so that the value P of a pulse modulation signal $P_{WM}$ is determined. FIG. 8 shows the wave form of the pulse modulation signal which is sent out from a pulse modulation signal generator. The ratio $D_V$ of the turn-on duration $t_{on}$ of the signal to the period T thereof is expressed as $D_V=ton/T=D_{Vty}=P)$. The electrical current $I_{SOL}$, which is caused to flow through the solenoid, is calculated in accordance with a formula $I_{SOL}=V_{MM}\cdot D_V/R_{SOL}$ if the efficiency and switching property of a driver for the solenoid are ideal. In that formula, $I_{SOL}$, $V_{MM}$ and $R_{SOL}$ are in the units of A, V and Ω, respectively. The constant electrical current can thus be caused to flow through the solenoid 15 despite the fluctuation in the voltage of the power supply.

Reference will now be made in detail to a method of the second preferred embodiment according to the present invention. Since many parts of this embodiment is the same as the first embodiment, the arts are indicated with the same reference number, and their detailed description is omitted here.

The second embodiment is a method of moving down the pen of a writing apparatus without spending an unnecessary waiting time.

In the writing apparatus of the second embodiment, when a character, a figure or the like is to be written on the surface P of the writing paper by the writing apparatus, the pen support arm 4 is swung down to put the pen 10 into contact with the surface of the paper and then moved along the x-axis and the y-axis to perform a step of writing with the pen on the surface of the paper, and is thereafter swung up, moved along the x-axis and the y-axis, swung down again to put the pen into contact with the surface of the paper and then moved along the axes to perform another step of writing with the pen on the surface of the paper. A number of such steps of writing are thus performed repeatedly with the pen 10 to write the character, the figure or the like on the surface P of the writing paper.

Figure 9:
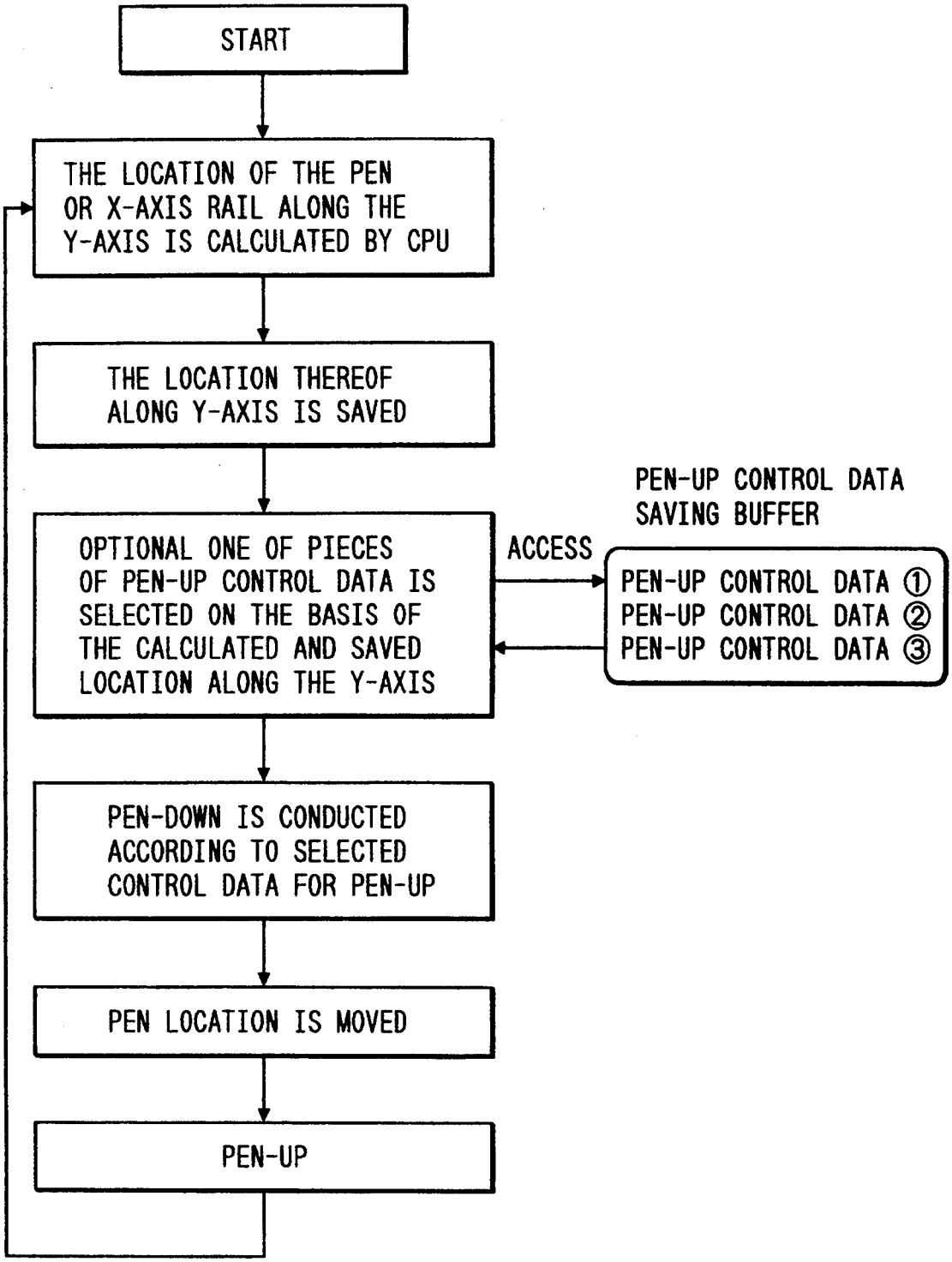
FIG. 9 is a flow chart for determining the time, quantity and duration of energizing of a solenoid.
Figure 12A:
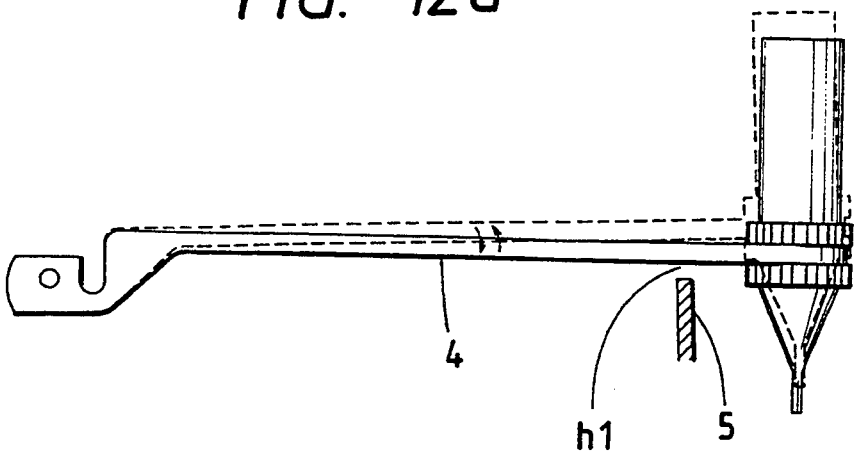
FIGS. 12(*a*) and 12(*b*) are views to illustrate the difference in the bounce of a pen support arm due to the difference in the location thereof along a y-axis.
Figure 12B:
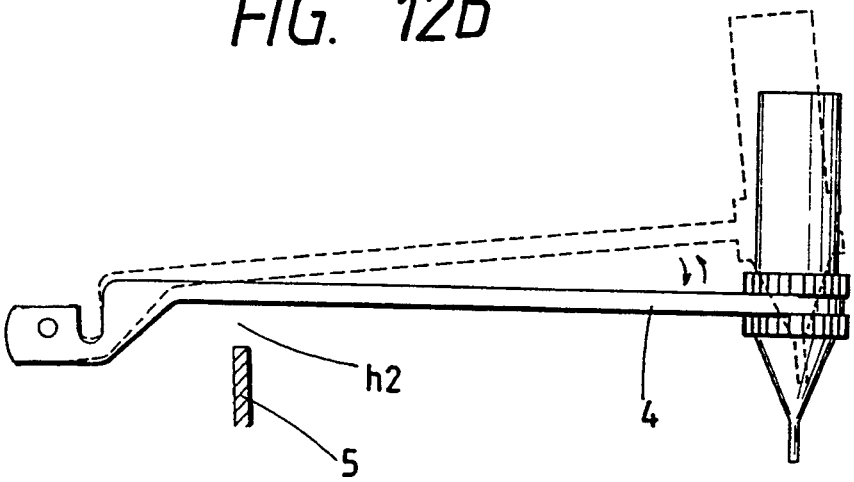

To swing the pen support arm 4 up and down to move the pen 10 up and down, the pen lifting rail 5 is swung up and down by de-energizing and energizing the solenoid 15 under the regulatory action of the controller. After the preceding step of writing is performed in the writing the character, the figure or the like on the surface of the paper, the solenoid 15 is de-energized to swing up the pen lifting rail 5 to swing up the pen support arm 4. Immediately after the upward swinging of the arm 4, the solenoid 15 should preferably be energized again to swing down the rail 5 to swing down the arm to put the pen 10 down into contact with the surface of the paper to perform the next step of writing. However, since the arm 4 bounces due to the impact of the swung-up rail 5 on the arm, the arm cannot be swung down until the bounce disappears. In the case that the pen 10 is located nearest the casing frame as shown in FIG. 12*a*), the bounce of the arm 4 is small as shown by a dotted line therein and the time which it takes the bounce of the arm 4 is large as shown by a dotted line therein and the time which it takes for the bounce to disappear is long. Therefore, if the time point at which the rail 5 is swung up to swing up the arm 4 were present depending on the time in the latter case, a waiting time which should be spent before the rail is swung up to swing up the arm in the former case would be longer than a necessary length so as to deteriorate the efficiency of the writing by the apparatus. For that reason, it is preferable that the time point at which the solenoid 15 is energized again so that the rail 5 swung up at the end of the preceding step of writing is swung down to swing down the arm 4 to perform the next step of writing is modulated depending on the location of the arm along the y-axis. For the modulation, the location of the arm 4 or the x-axis rail 2 is calculated, and optimal one of pieces of pen lifting rail control data is selected depending on the calculated location, to determine the time point at which the solenoid 15 is energized again to swing down the arm to move down the pen 10, as shown in FIG. 9 which is a flow chart. The selection is performed on the basis of the y-axis ordinate Ty of the calculated location as follows:

```
Data 1) if (Ty) < Y1
Data 2) if Y1 = or < (Ty) < Y2
Data 3) if Y2 = or < (Ty) < Y3
.
.
.
.
```

The time point at which the pen lifting rail 5 swung up at the end of the preceding step of writing is swung down to swing down the arm 4 to perform the next step of writing is thus determined depending on the location of the arm or the x-axis rail 2 along the y-axis so that the next series of writing is started at the optimal time point wherever the arm is located. In other words, the unnecessary writing time is not spent before the starting, and the time interval from the preceding step of writing to the next step of writing is shortened to enhance the efficiency of the writing by the apparatus.

The magnitude of the bounce of the arm 4 due to the contact of the swung-up rail 5 therewith depends on not only the location of the arm or the x-axis rail 2 along the y-axis, but also the magnitude of an electrical current which is caused to flow through the solenoid 15 to drive it. Since the magnitude of the current depends on that of the voltage of a power supply for the solenoid 15, the fluctuation in the voltage is monitored by the central processing unit of the controller to keep the magnitude of the current constant despite the fluctuation, as shown in FIG. 10 which is a block diagram. Processing with the block diagram is described from now on. The $V_{MM}$ of a power supply for the solenoid 15 is first converted into a digital value in accordance with a formula $D_V=A_DV_{MM})$ wherein $D_V$ is a parameter. Pulse modulation signal data prepared in a program or a table is subjected to a converting calculation in accordance with a formula $P=P_{WM}D_V)$ so that the value P of a pulse modulation signal $P_{WM}$ is determined. FIG. 11 shows the wave form of the pulse modulation signal which is sent out from a pulse modulation signal generator. The ratio $D_V$ of the turn duration $t_{on}$ of the signal to the period T thereof is expressed as $D_V = ton/T = D_{Vty}P$). The electrical current $I_{SOL}$, which is caused to flow through the solenoid, is calculated in accordance with a formula $I_{SOL} \fallingdotseq V_{MM} \cdot D_V / R_{SOL}$ if the efficiency and switching property of a driver for the solenoid are ideal. In that formula, $I_{SOL}$, $V_{MM}$ and $R_{SOL}$ are in the units of A, V and Ω, respectively. The constant electrical current can thus be caused to flow through the solenoid 15 despite the fluctuation in the voltage of the power supply.

Although modulating the time point, quantity and duration of the energizing of the solenoid 15 and keeping the magnitude of the electrical current for the solenoid constant are performed in the method of moving down the pen 10 of the writing apparatus, such modulating and keeping can also be applied to a writing or drawing apparatus of other type.

Reference will now be made in detail to a modification of the first and second preferred embodiment according to the present invention. Since many parts of this embodiment is the same as the first embodiment, the arts are indicated with the same reference number, and their detailed description is omitted here.

Figure 13:
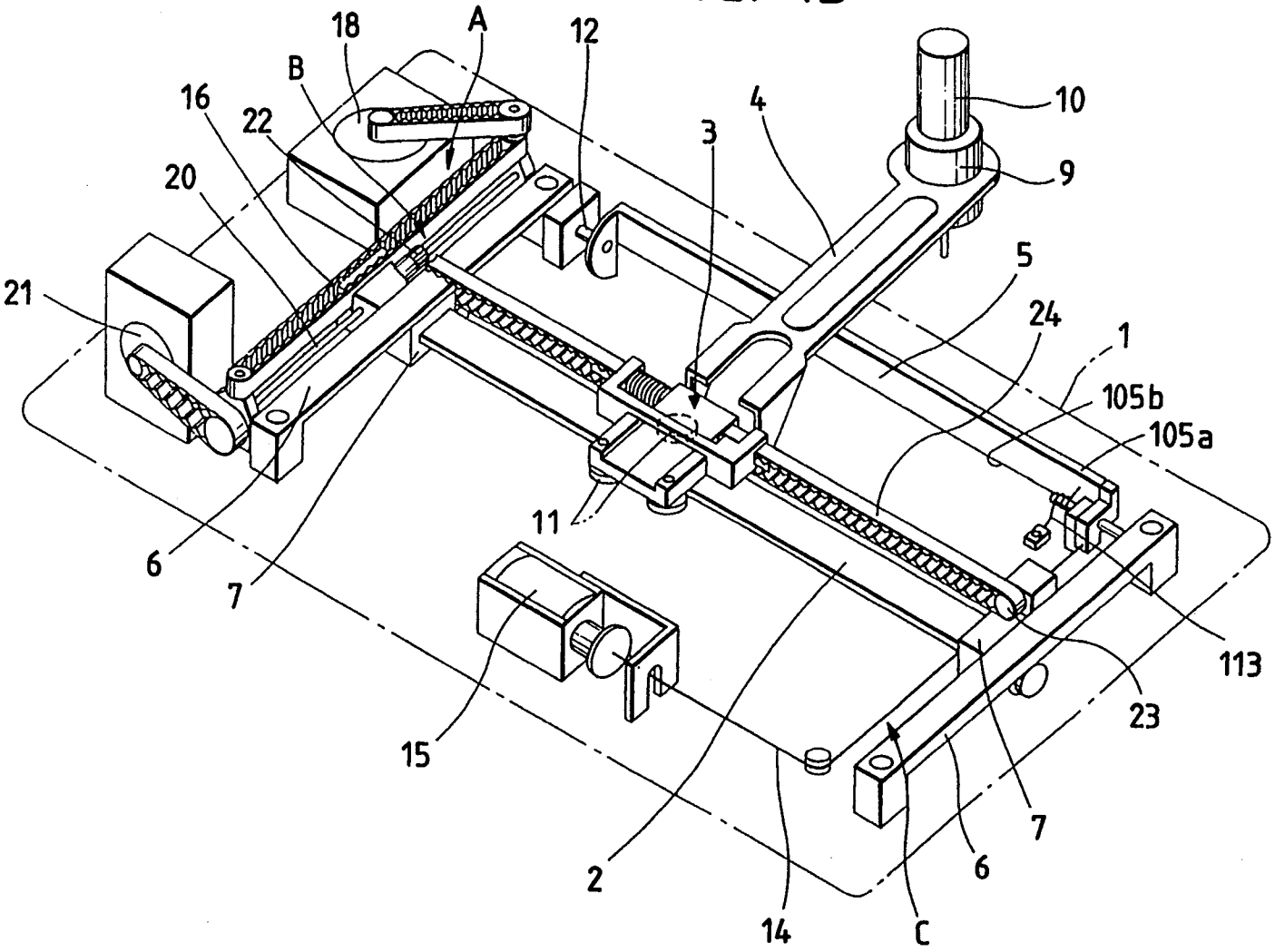
FIG. 13 is a perspective view of a writing apparatus according to a second embodiment of the present invention.
Figure 14A:
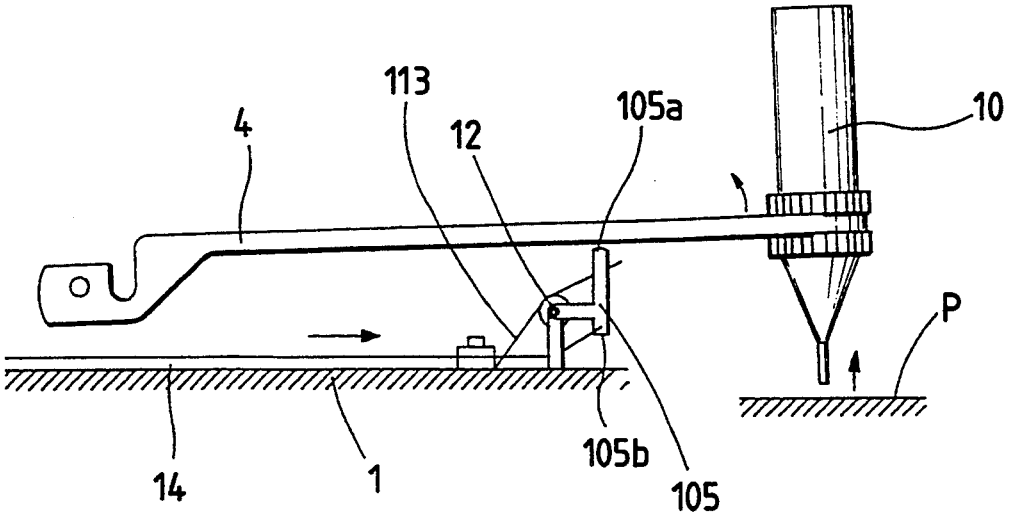
FIGS. 14(*a*) and 14(*b*) are views of the apparatus to illustrate the operation of a pen lifting rail.
Figure 14B:
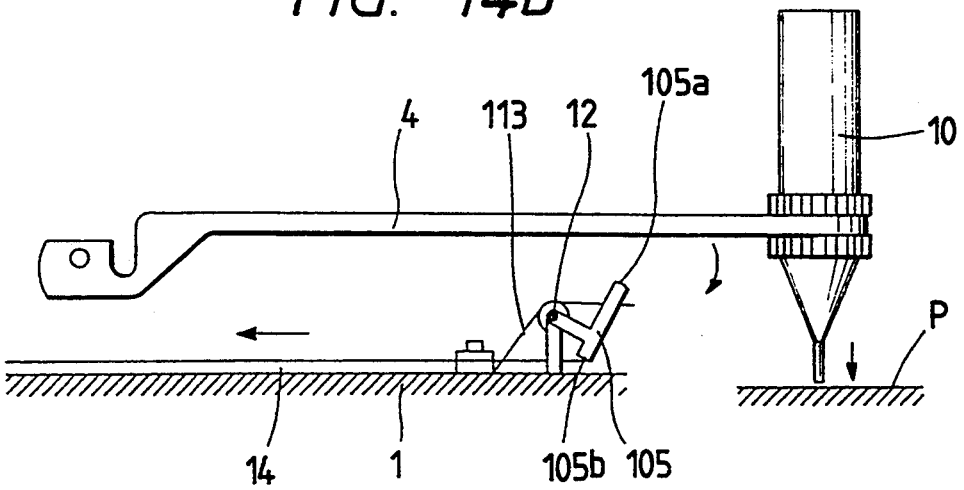
Figure 15:
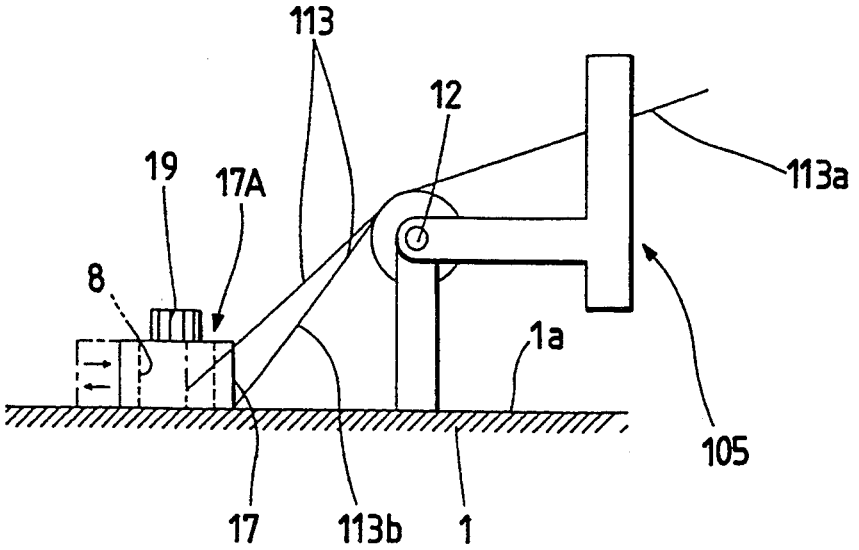
FIG. 15 is a view of apparatus to illustrate the helical torsion spring force modulation means of an impact noise reduction mechanism for the apparatus.

The above-mentioned embodiments may be modified in such a manner that the helical torsion spring 113 is engaged at one end 113*a* thereof with the pen lifting rail 105 and at the other end 113*b* of the spring with an engagement portion 17, as shown in FIGS. 13–15. The engagement portion 17 is constituted by the contact surface of an engagement block 17A provided on the lower portion 1*a* of the casing frame 1, and has a slender hole 18 through which a screw 19 extends. The screw 19 is engaged in a tapped hole provided in the lower portion of the casing frame 1 but not shown in the drawings. When the screw 19 is loosened, the engagement block 17A can be displaced toward or away from the pen lifting rail 105. The screw 19 can be tightened to secure the block 17A in a desired location to modulate the location of the engaged end 113*a* of the helical torsion spring 113 in the longitudinal direction thereof to preset the rail swinging force of the spring.

The location of the engaged end 113*b* of the helical torsion spring 113 for swinging up the pen lifting rail 105 can be modulated in the longitudinal direction of the spring by changing the location of the engagement block 17A, to alter the upward swinging force of the spring, as mentioned above. For that reason, if the dimensions or/and assembly of the components of the writing apparatus are inaccurate, the stiffness of the spring 113 is not equal to a prescribed value or/and the spring is fatigued to alter the upward swinging force thereof, the location of the engagement block 17A is changed to preset the upward swinging force of the spring to swing up the rail 105 into contact with the pen support arm 4 always a prescribed time after the deenergizing of the solenoid 15 so as to heighten the noise reduction effect of the noise reduction mechanism.

Figure 16:
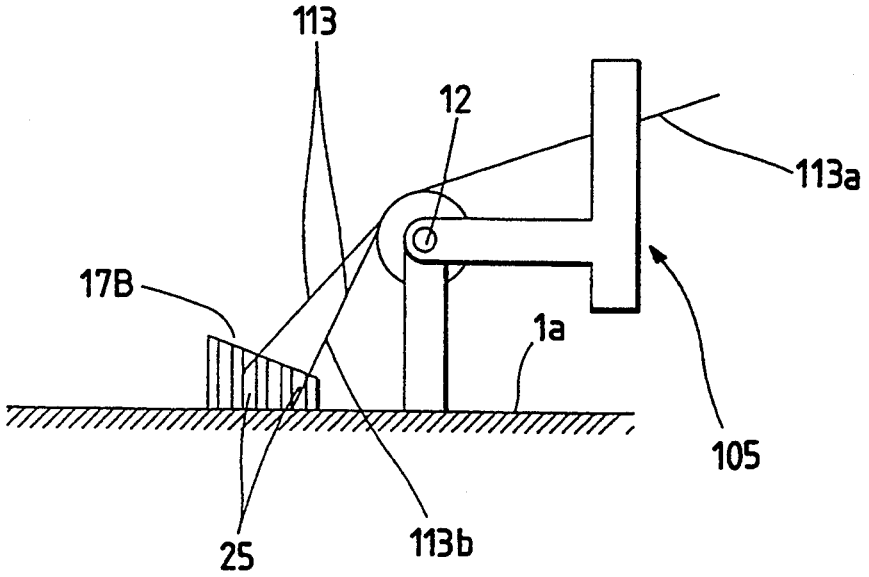
FIG. 16 is a view of a helical torsion spring force modulation means which is a modification of the former.
Figure 17:
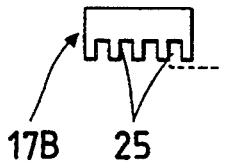
FIG. 17 is a plan view of the engagement member of the latter means.

The present device is not confined to the above-described means for modulating the location of the engaged end 113*b* of the helical torsion spring 113 to preset the upward swinging force thereof for the pen lifting rail 105. For example, the means may be replaced with a means including an engagement member 17B secured to the lower portion 1*a* of the casing frame 1 and having a plurality of engagement grooves 25 juxtaposed together toward the rail 105, as shown in FIGS. 16 and 17. In the case of the use of the latter means, the spring 113 is engaged at one end 113*b* thereof in selected one of the engagement grooves 25 of the engagement member 17B to modulate the location of the engaged end of the spring in the longitudinal direction thereof. Besides, such an engagement member does not necessarily need to be provided on the casing frame 1, but may be provided on the rail 105. For example, a plurality of engagement portions may be formed on the rail to engage the spring 113 at one end thereof with selected one of the portions. Furthermore, the locations of both the engaged ends of the spring 113 may be modulated to preset the upward swinging force thereof.

Figure 18:
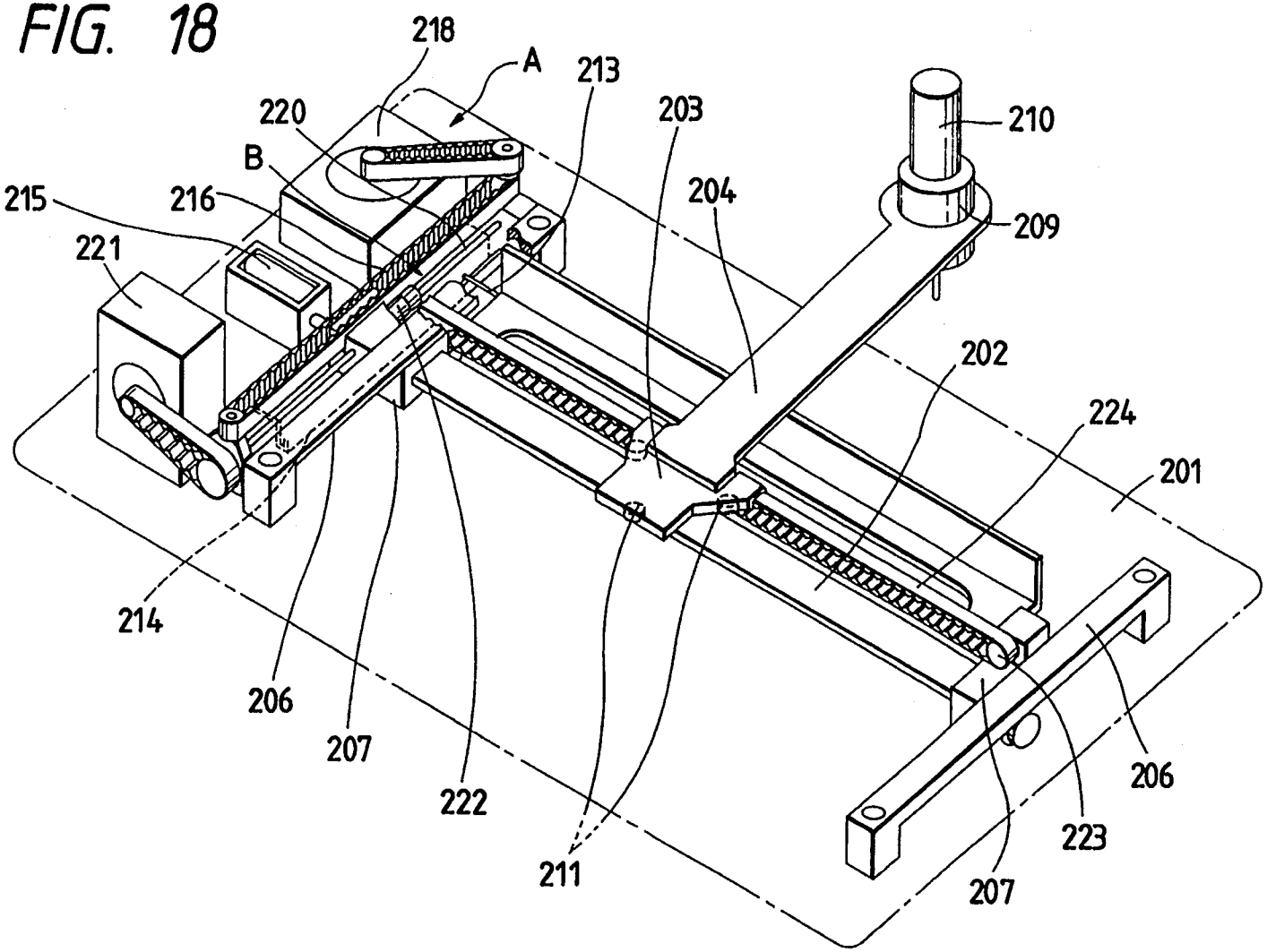
FIG. 18 is a perspective view of a writing apparatus according to a third embodiment of the present invention.

A third embodiment of the present device is hereafter described with reference to the drawings attached hereto. The embodiment is a mechanism for moving a pen up and down in a writing apparatus shown in FIGS. 18 and 19.

The writing apparatus includes a casing frame 201; an x-axis rail 202 supported by the frame so as to be movable relative to the frame along a horizontal y-axis; an x-axis carriage 203 supported by the rail so as to be movable relative to the rail along a horizontal x-axis perpendicular to the y-axis; a pen support arm 204 which is supported at the butt thereof with a hinge by the carriage so as to be swingable up and down, and supports the pen 210 at the tip of the arm; the pen lifting rail 205 for swinging the arm up and down to move the pen up and down; a drive mechanism A for moving the arm with the x-axis rail along the y-axis; a drive mechanism B for moving the arm with the carriage along the x-axis; and a controller for regulating the drive mechanism. The apparatus also includes guide rails 206 provided near the right and left sides of the casing frame 201 and extending in parallel with each other along the y-axis; y-axis carriages 207 secured to the x-axis rail 202 at both the ends thereof so as to be movable along the guide rails; a pen holder 209 attached to the pen support arm 204 at the tip thereof; the pen 210 removably screw-engaged with the holder; and rollers 211 attached to the x-axis carriage 203 and pinching the x-axis rail at both the side edges thereof so that the carriage can be moved with the rollers on the rail along the longitudinal direction thereof.

Figure 19:
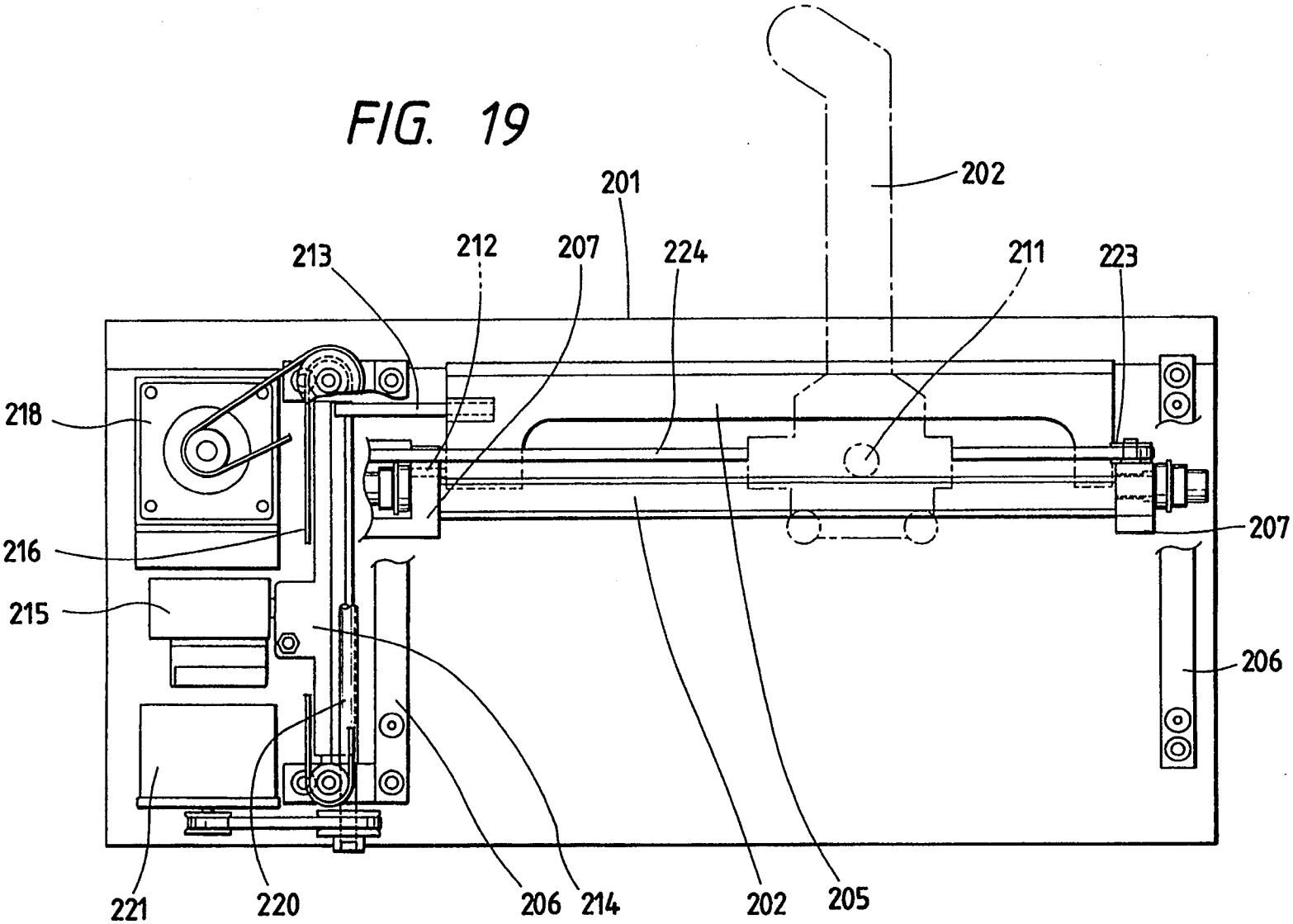
FIG. 19 is a plan view of the apparatus.
Figure 20:
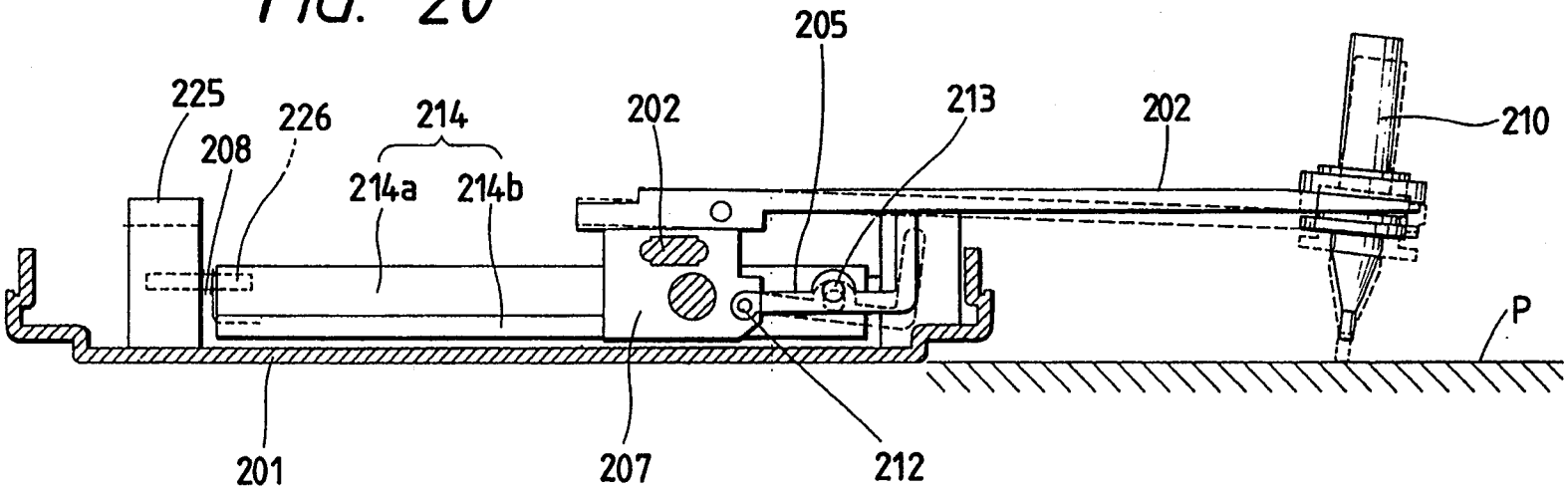
FIG. 20 is a side view of a mechanism for moving the pen of the apparatus up and down.

The pen lifting rail 205 is a slender plate, and fitted with rotary pins 212 extending from both the end portions of the rail and rotatably supported by the y-axis carriage 207, as shown in FIGS. 19 and 20. A jut 213 extends from one end portion of the rail 205 along the x-axis, and is located away from the axis of the rotation of the rotary pin 212. The pins 212 extend in parallel with the x-axis rail 202. The pin lifting rail 205 may not be thus coupled to the y-axis carriages 207 by the pins 212, but may be coupled to members coupled to the carriages but not shown in the drawings.

Figure 21:
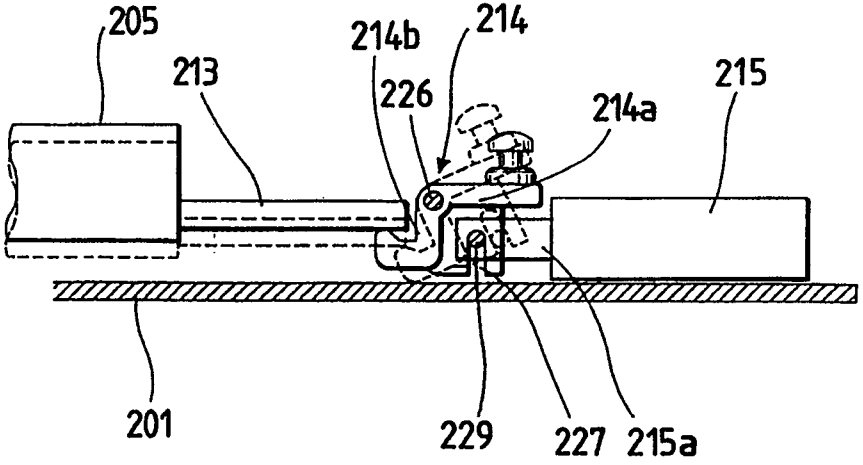
FIG. 21 is a front view of the mechanism.

An operating member 214 is kinematically associated with the pen lifting rail 205, and extends along the total length of the movement of the x-axis rail 202 along the y-axis. The member 214 is a slender plate, and has an upper horizontal portion 214*a* and a lower portion 214*b* having a J-shaped cross section and conjoined to the upper portion to form a right angle between them, as shown in FIGS. 19, 20 and 21. The member 214 is pivotally supported with a pin 226 on a support member 225 provided on the lower portion of the casing frame 201. The pin 226 is fitted in the member 214 at the joint of the portions 214*a* and 214*b* thereof. The lower projection of the lower portion 214b is located under the jut 213 extending from the pen lifting rail 205. The member 214 has a projection 228 located under the central part of the horizontal portion 214a and having a groove 227 extending along the longitudinal direction of the member. A pin 229 is engaged at one end thereof in the groove 227 and at the other end of the pin in an actuation pin 215a combined with a solenoid 215 secured to the casing frame 201. A spring 208 shown in FIG. 20 always urges the member 214 in such a direction as to swing up the lower portion 214b thereof. When the solenoid 215 is de-energized, the actuation pin 215a is protruded so that the lower projection of the lower portion 214b of the operating member 214 comes up into contact with the bottom of the jut 213 on the pen lifting rail 205 to swing it up, as shown by full lines in FIG. 21. When the solenoid 215 is energized, the actuation pin 215a is retracted to pull the projection 228 of the member 214 to swing it about the pin 226 to move down the lower portion 214b of the member out of contact with the jut 213 on the rail 205 so that the rail is let to swing down, as shown by dotted lines in FIG. 21. At that time, the pen support arm 204 gravitates so that the pen 210 falls into contact with the surface P of writing paper. When the solenoid 215 is thereafter de-energized, the actuation pin 215a is protruded to swing the operating member 214 back about the pin 226 by the spring 208 to swing up the pen lifting rail 205 to swing up the arm 204 so that the pen 210 rises out of contact with the surface P of the paper. Although the operating member 214 is swung up and down by the solenoid 215, a member which is straightly moved up and down may be provided instead of the operating member.

The drive mechanism A for moving the pen support arm 204 along the y-axis is provided on the casing frame 201, and includes the x-axis rail 202, the y-axis carriages 207 secured to the rail and movable along the y-axis, a timing belt 216 extending along the y-axis and coupled to one of the carriages, and a step motor 218 for revolving the belt to move the rail along the y-axis. When the step motor 218 is put in action, the timing belt 216 is revolved to move the carriages 207 and the rail 202 together along the y-axis to move the arm 204 along the axis.

The drive mechanism B for moving the pen support arm 204 along the x-axis is provided on the casing frame 201, and includes the x-axis carriage 203, a rotary shaft 220 provided under the timing belt 216 and extending along the y-axis, a step motor 221 connected to the shaft to rotate it to move the carriage along the x-axis, a toothed pulley 222 supported by one of the y-axis carriages 207 so as to be rotatable together with the shaft and slidable thereon, another toothed pulley 223 supported by the other of the y-axis carriages, and a timing belt 224 engaged with both the pulleys and secured to the x-axis carriage. When the step motor 221 is put in action, the rotary shaft 220 is rotated to revolve the timing belt 224 through the action of the toothed pulleys 222 and 223 to move the x-axis carriage 203 along the x-axis to move the arm 204 along the axis.

The step motors 218 and 221 are connected to the controller made of a microcomputer but not shown in the drawings. Commands are sent from the controller in order to rotate the step motors 218 and 221 by prescribed quantities. The y-axis carriage 207 supporting the pulley 222 is slidable on the rotary shaft 220.

when a character, a figure or the like is to be written on the surface P of the writing paper by the writing apparatus, the pen support arm 204 is swung down to put the pen 210 into contact with the surface of the paper and then moved along the x-axis and the y-axis to perform a step of writing with the pen on the surface of the paper, and is thereafter swung up, moved along the x-axis and the y-axis, swung down again to put the pen into contact with the surface of the paper and then moved along the axes to perform another step of writing with the pen on the surface of the paper. A number of such steps of writing are thus performed repeatedly with the pen 210 to write the character, the figure or the like on the surface P of the paper.

To swing the pen support arm 204 up and down to move the pen 210 up and down, the pen lifting rail 205 is swung up and down by de-energizing and energizing the solenoid 215 under the regulatory action of the controller. Since the rail 205 is supported together with the x-axis rail 202 by the y-axis carriages 207, both the rails are moved together. The pen support arm 204 is moved together with the x-axis rail 202 along the y-axis. For these reasons, the pen lifting rail 205 always comes into contact with the same portion of the arm 204 so that the length of the vertical swinging of the arm due to that of the rail is always constant. As a result, the length of the vertical swinging of the arm 204 is not made excessively large to cause the pen 210 to bounce to deteriorate the quality of the writing by the apparatus, and is not made excessively small to cause the pen to engage with the writing paper to damage it. Although the pen support arm 204 needs to be swung up, then horizontally moved and thereafter swung down in proceeding from one step of writing to another step of writing, the time which it takes to perform the proceeding is always constant wherever the pen 210 is located along the x-axis and the y-axis. For that reason, the writing operation of the apparatus is efficient.

A fourth embodiment of the present device is hereafter described with reference to the drawings attached hereto. The fourth embodiment is a mechanism for controlling the movement of the x-axis rail 302 of a writing apparatus along a horizontal y-axis to move the rail precisely in parallel with the axis.

Figure 22:
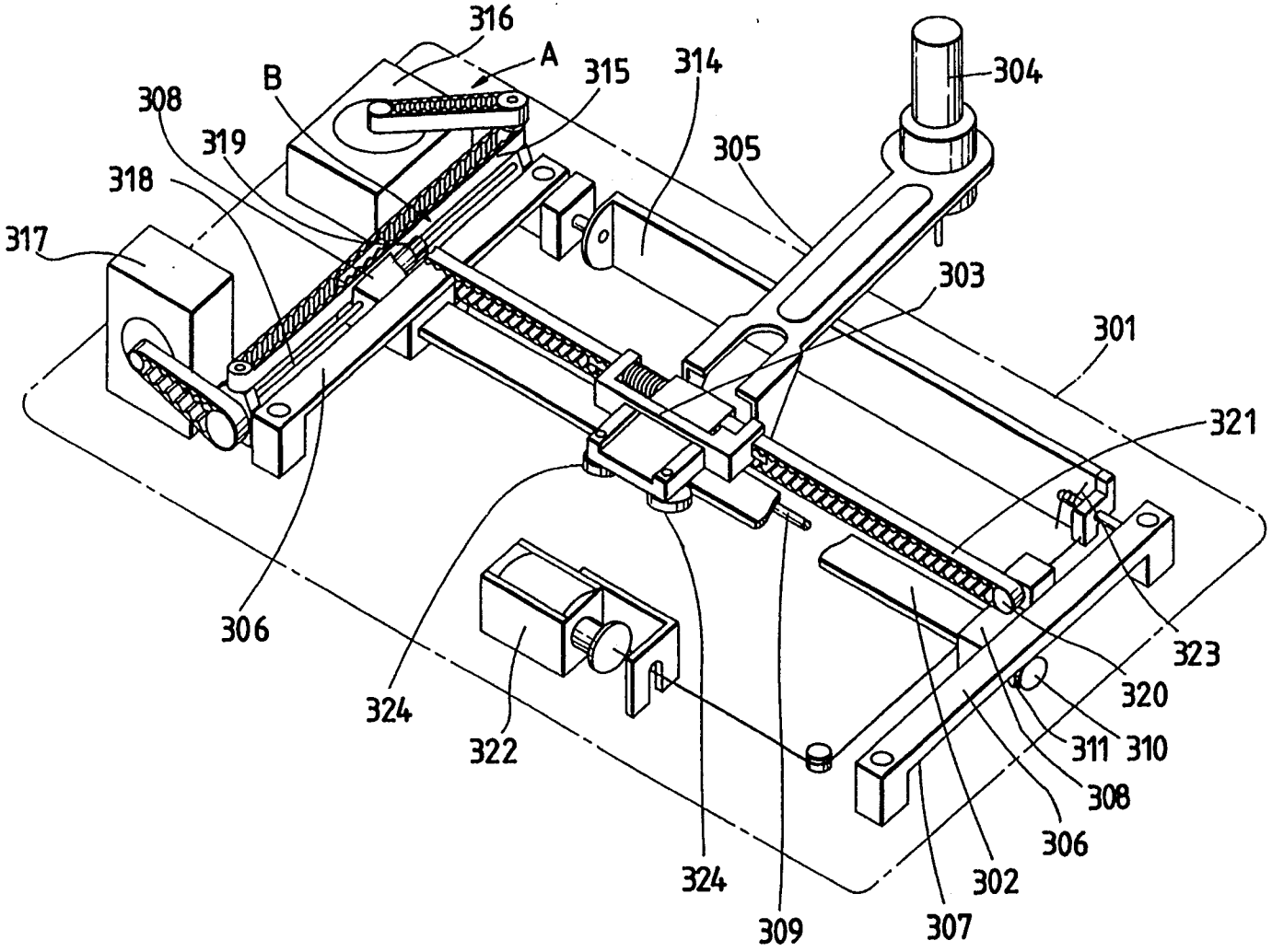
FIG. 22 is a perspective view of a writing apparatus according to a fourth embodiment of the present invention.
Figure 23:
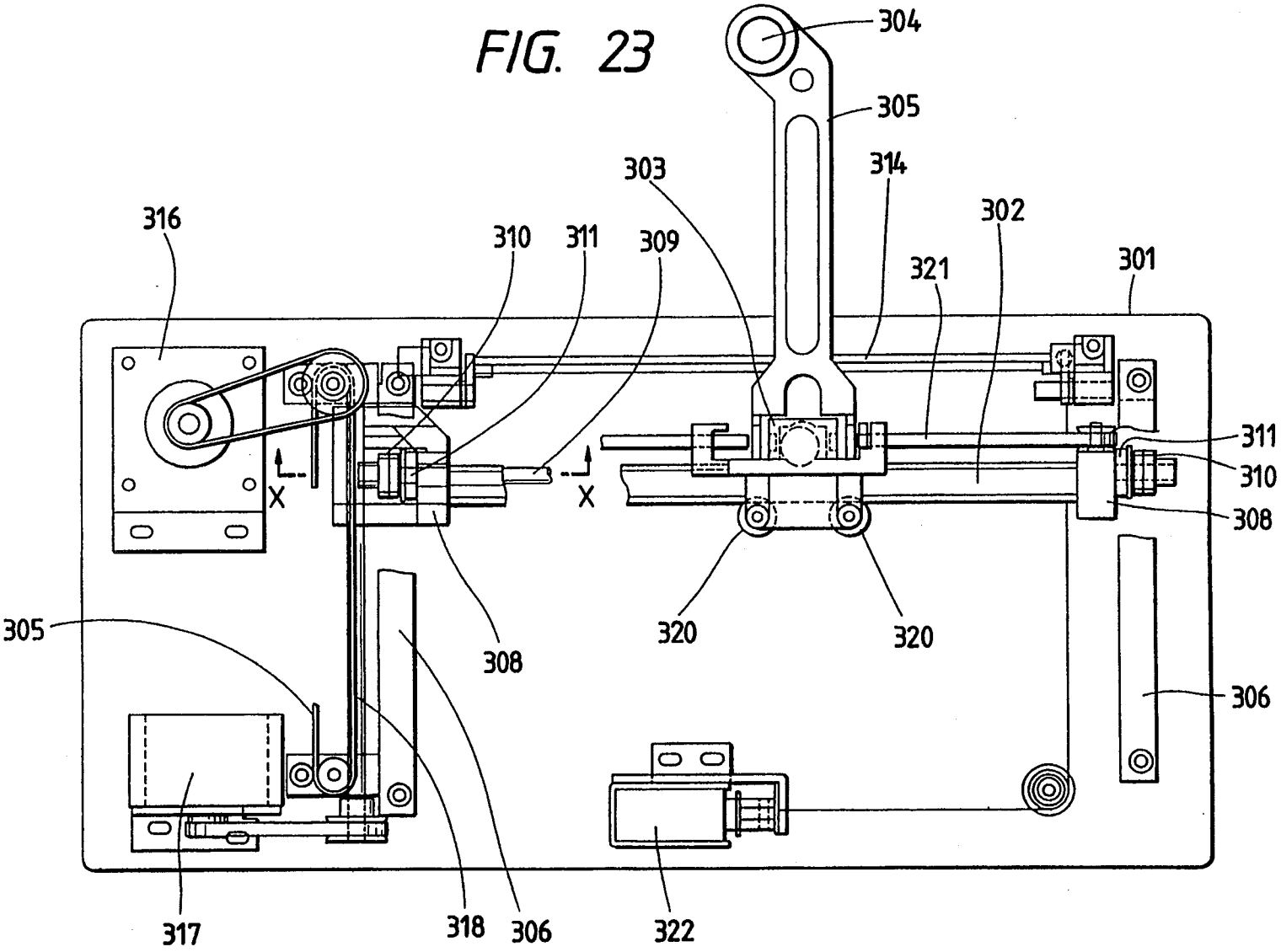
FIG. 23 is a plan view of the apparatus.

As shown in FIGS. 22 and 23, the writing apparatus includes the x-axis rail 302 supported by a casing frame 301 so as to be movable relative to the frame along the horizontal y-axis, an x-axis carriage 303 supported by the rail so as to be movable relative to the rail along a horizontal x-axis perpendicular to the y-axis, a pen support arm 305 supported at the butt thereof by the carriage and holding a pen 304 at the tip of the arm, a drive mechanism A for moving the rail along the y-axis, a drive mechanism B for moving the carriage along the x-axis, and a controller for regulating the drive mechanisms.

Rack rails 306 are provided at a prescribed distance from each other on the lower portion 312 of the casing frame 301 near the right and left ends of the x-axis rail 302, and extend along the y-axis. The racks 307 of the rack rails 306 face down.

Figure 24:
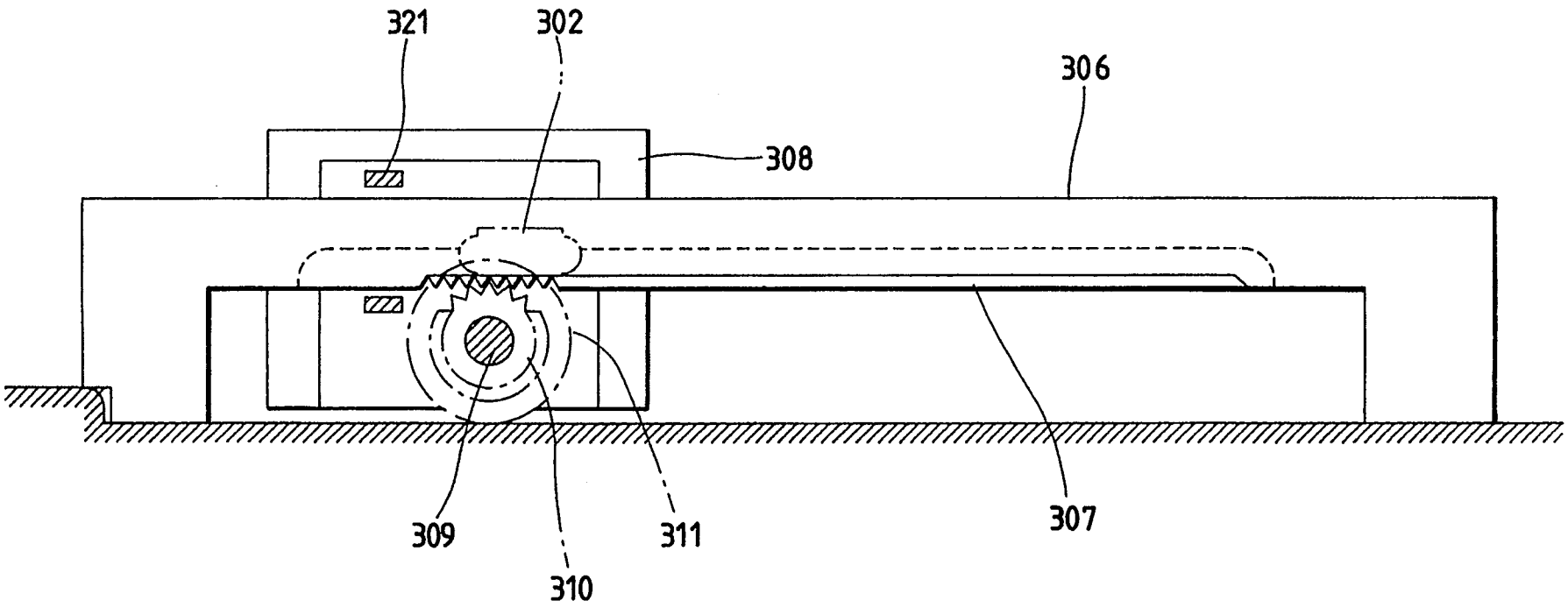
FIG. 24 is a view of the apparatus to illustrate the state of engagement of a rack rail and a pinion and the state of rolling of a roller.
Figure 25:
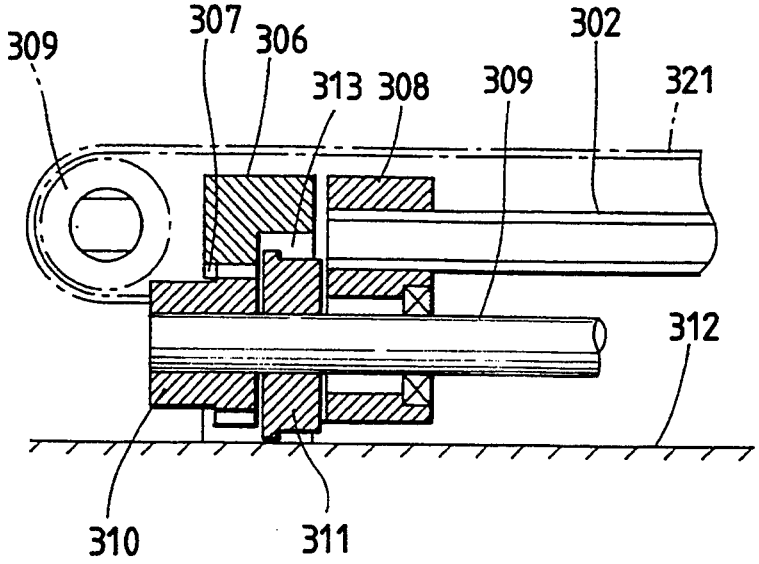
FIG. 25 is a sectional view of the apparatus along lines X shown in FIG. 23.

Y-axis carriages 308 are secured to the x-axis rail 302 at both the ends thereof, and coupled to each other by a shaft 309 provided under the rail. Pinions 310 are secured to the shaft 309 at both the ends thereof, and engaged with the racks 307 of the rack rails 306, as shown in FIGS. 24 and 25. Rollers 311 are secured to the shaft 309 at both the ends thereof inside the pinions 310 concentrically thereto, and disposed in contact with the lower portion 312 of the casing frame 301 so as to keep the pinions engaged with the racks 307. Other means for keeping the pinions 310 engaged with the racks 307 may be provided instead of the rollers 311.

Figure 26A:
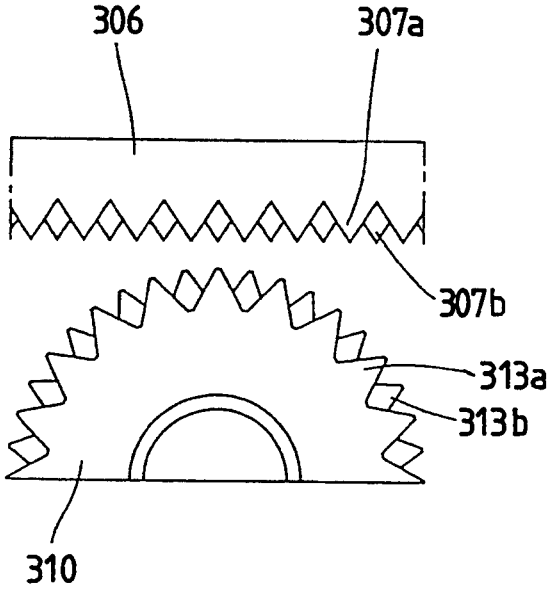
FIGS. 26(*a*) and 26(*b*) are a side view and a front view of a rack rail and a pinion in the case that each of them has different series of teeth having a positional difference of half pitch.
Figure 26B:
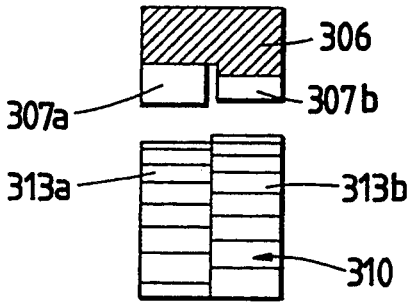

The teeth of each pinion 310 may be constituted by a series of teeth 313*a* and another series of teeth 313*b* having a positional difference of half pitch from the former, and the teeth of each rack 307 may be constituted by a series of teeth 307*a* and another series of teeth 307*b* having a positional difference of half pitch from the former, correspondingly to the pinion, as shown in FIGS. 26*a*) and 26*b*).

The pen support arm 305 is supported at the butt thereof with a hinge by the x-axis carriage 303 so that the arm can be swung up and down relative to the carriage. The arm 305 holds the pen 304 at the tip of the arm. The x-axis carriage 303 is fitted with rollers 324 pinching the x-axis rail 302 at both the side edges thereof so that the carriage can be moved with the rollers on the rail along the x-axis.

A pen lifting rail 314 is supported in front of the x-axis rail 302 so that the lifting rail can be swung up into contact with the bottom of the pen support arm 305 to push it up to move up the pen 304 from the surface of writing paper, and swung down to let the arm gravitate to move down the pen into contact with the surface of the paper. The upward and downward swinging of the pen lifting rail 314 is performed by a conventional mechanism including a solenoid 322 and a helical torsional spring 323.

The drive mechanism A for moving the pen support arm 305 along the y-axis is provided on the casing frame 301, and includes the x-axis rail 302, the y-axis carriages 308 secured to the rail and movable along the y-axis, a timing belt 315 extending along the y-axis and coupled to one of the carriages, and a step motor 316 for revolving the belt to move the rail along the y-axis. When the step motor 318 is put in action, the timing belt 315 is revolved to move the carriages 308 and the rail 302 together along the y-axis to move the pen support arm 305 along the axis.

The drive mechanism B for moving the pen support arm 305 along the x-axis is provided on the casing frame 301, and includes the x-axis carriage 303, a rotary shaft 318 provided under the timing belt 315 and extending along the y-axis, a step motor 317 connected to the shaft to rotate it to move the carriage along the x-axis, a toothed pulley 319 supported by one of the y-axis carriages 308 so as to be rotatable together with the shaft and slidable thereon, another toothed pulley 320 supported by the other of the y-axis carriages, and a timing belt 321 engaged with both the pulleys and secured to the x-axis carriage. When the step motor 317 is put in action, the rotary shaft 320 is rotated to revolve the timing belt 321 through the action of the toothed pulleys 319 and 320 to move the x-axis carriage 303 along the x-axis to move the pen support arm 305 along the axis.

The step motors 316 and 317 are connected to the controller made of a microcomputer but not shown in the drawings. Commands are sent from the controller in order to rotate the step motors 316 and 317 by prescribed quantities. The y-axis carriage 308 supporting the pulley 319 is slidable on the rotary shaft 318.

When a character, a figure or the like is to be written on the surface of the writing paper by the writing apparatus, the pen support arm 305 is swung up and down and moved along the x-axis and the x-axis rail 302 is moved along the y-axis. When the x-axis rail 302 is moved along the y-axis, the rollers 311 on the shaft 309 coupling the y-axis carriages 308 to each other roll on the lower portion of the casing frame 301, and the pinions 310 roll on the racks 307 of the rack rails 306 as the pinions remain engaged with the racks. For that reason, although the timing belt 315 is provided only at one end of the x-axis rail 302, the pinions 310 at both the ends of the rail are moved in conjunction with each other so that the pinions are simultaneously rotated in the same direction by the same number of rounds. Because of this constitution and operation, the positions of the pinions 310 do not deviate from each other even if the arm 305 is forcibly pulled out much from the casing frame 1 along the y-axis. It is thus ensured that the x-axis rail 302 is always precisely moved in parallel with the y-axis not to make the writing of the character, the figure or the like improper. Since the racks 307 of the rack rails 306 have the teeth on the lower sides thereof, dust or the like is less likely to come to cling to the teeth. For that reason, the engagement of the racks 307 with the pinions 310 is kept smooth to stabilize the quality of the writing. If the teeth of each rack 307 and those of each pinion 310 are constituted by the different series of teeth having the positional difference of half pitch, as mentioned above, they are prevented from undergoing backlash at the beginning of the reverse revolution of the timing belt 315, so that the quality of the writing is more improved.

Figure 27:
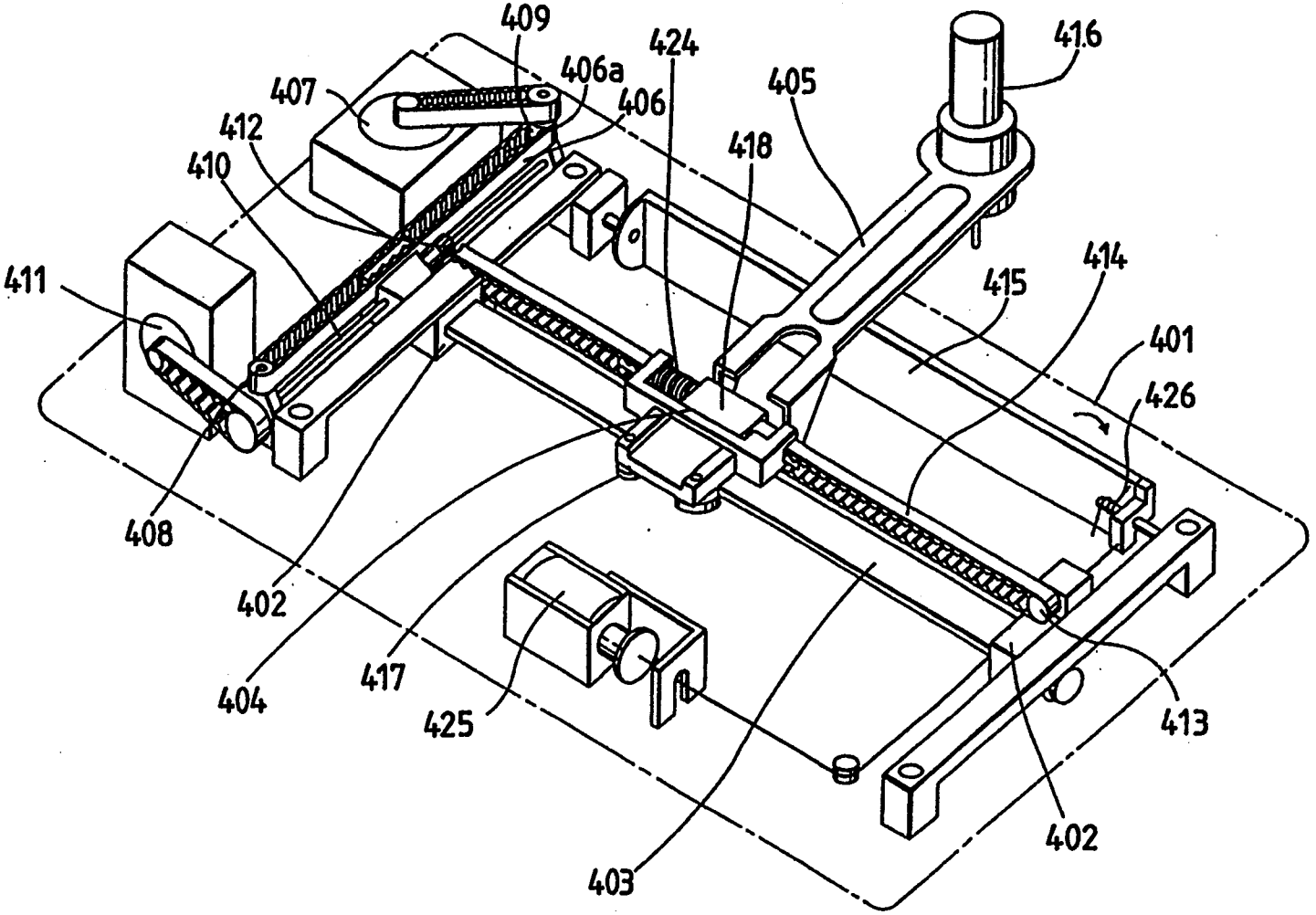
FIG. 27 is a perspective view of a writing apparatus according to a modification in the embodiments of the present invention.

A modification of the above-mentioned embodiments according to the present invention is hereafter described with reference to the drawings attached hereto. The modification is a mechanism for attaching the end portions of a timing belt 406 or 414 to a y-axis carriage 402 or an x-axis carriage 404 in the writing apparatus shown in FIG. 27.

The writing apparatus includes a casing frame 401, two y-axis carriages 402 movable relative to the frame along a horizontal y-axis, an x-axis rail 403 and secured to the y-axis carriages at both the ends of the rail, the x-axis carriage 404 supported by the rail so as to be movable relative to the rail along a horizontal x-axis perpendicular to the y-axis, a pen support arm 405 supported at the butt thereof by the x-axis carriage, a pen 416 held by the arm at the tip thereof, a drive mechanism for moving the y-axis carriages 402 along the y-axis to move the x-axis rail along the y-axis, and a drive mechanism for moving the x-axis carriage along the x-axis to move the arm along the x-axis.

The drive mechanism for moving the y-axis carriages 402 along the y-axis includes the timing belt 406 extending as a loop along the y-axis and fastened at the end portions of the belt to one of the carriages, a step motor 407 coupled to the belt to revolve it for the movement, and toothed pulleys 408 and 409 provided near both the ends of the travel of the carriage and engaged with the teeth 406*a* of the inner side of the belt.

The drive mechanism for moving the x-axis carriage 404 along the x-axis includes a rotary shaft 410 extending along the y-axis, a step motor 411 coupled to the shaft to rotate it for the movement, a toothed pulley 412 supported by the above-mentioned one of the y-axis carriages 402 so as to be slidable relative to the shaft but rotatable together therewith, another toothed pulley 413 supported by the other of the y-axis carriages, and the timing belt 414 engaged with the pulleys and fastened at the end portions of the belt to the x-axis carriage.

The writing apparatus also includes a pen lifting rail 415 supported in front of the x-axis rail 403 so that the pen lifting rain can be swung up and down. When the lifting rail 415 is swung up, it comes in contact with the bottom of the pen support arm 405 to push it up to move up the pen 416 from the surface of writing paper. When the lifting rail 415 is swung down, the arm 405 gravitates to let the pen 416 fall into contact with the surface of the paper. The upward and downward swinging of the lifting rail 415 is performed by a conventional swinging mechanism including a solenoid 425 and a helical torsion spring 426.

When the step motor 407 is put in action, the timing belt 406 is revolved to move the y-axis carriages 402 along the y-axis to move the x-axis rail 403 along the axis. As a result, the pen support arm 405 on the x-axis rail 403 is also moved along the y-axis. When the other step motor 401 is put in action, the rotary shaft 410 is rotated to revolve the timing belt 414 through the action of the toothed pulleys 412 and 413 to move the x-axis carriage 404 along the x-axis to move the pen support arm 405 along the axis. The step motors 407 and 411 are connected to a controller made of a microcomputer but not shown in the drawings. The controller sends out commands to rotate the motors 407 and 411 by prescribed quantities. The y-axis carriage 402 located at the rotary shaft 410 is slidable relative thereto.

When a character, a figure or the like is to be written on the surface of the writing paper by the writing apparatus, the x-axis rail 403 is moved along the y-axis and the pen support arm 405 is moved along the x-axis as the arm is swung up and down into and out of contact with the surface of the paper by swinging the pen lifting rail 415 up and down. The drive mechanisms and the swinging mechanism are regulated by the controller.

Figure 28:
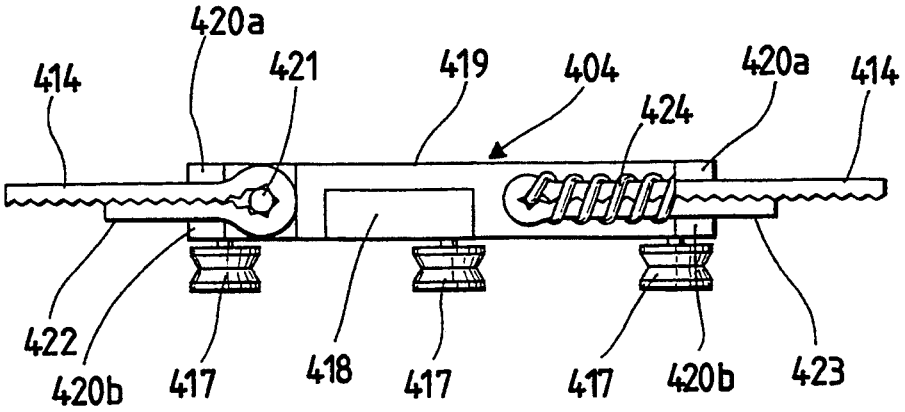
FIG. 28 is a front view of a mechanism for attaching a timing belt at the ends thereof to a carriage.
Figure 29:
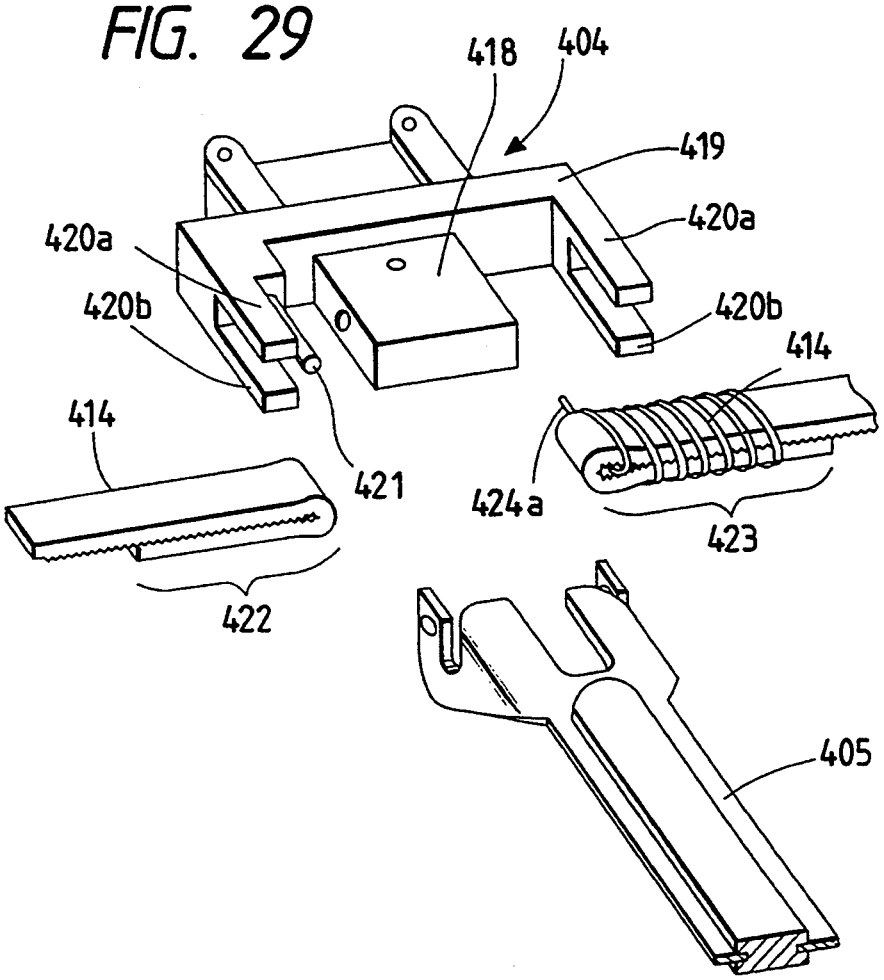
FIG. 29 is an exploded perspective view of the mechanism.

The mechanism which is the modification is described in detail with reference to FIGS. 28 and 29 as to the case that the timing belt 414 is attached at the ends thereof to the x-axis carriage 404 which is for moving the pen support arm 405 along the x-axis. The x-axis carriage 404 is fitted with rollers 417 pinching the x-axis rail 403 at both the side edges thereof. The carriage 404 has a block portion 418 supporting the pen support arm 405 at the butt thereof so that the arm can be sung up and down. The carriage 404 also has an attaching portion 419 to which the timing belt 414 is attached. The attaching portion 419 has pairs of upper and lower guide juts 420*a* and 420*b* located at both the ends of the attaching portion and extending rectangularly across the longitudinal direction of the timing belt 414. The distance between the upper and lower guide juts 420*a* and 420*b* is nearly equal to the thickness of each of the bent-back and folded end portions 422 and 423 of the belt 414, which are formed by bending the belt back and then folding it at the ends thereof so that the teeth 414*a* of the belt are located inside. The attaching portion 419 also has an engagement pin 421 extending inside the guide juts 420*a* and 420*b* along them. The bent-back and folded end portion 422 is laid through between one of the pairs of guide juts 420*a* and 420*b*, and engaged with the engagement pin 421 at the end of the portion. Since the teeth of the portion 422 are engaged with each other and it is fitted in between the guide juts 420*a* and 420*b* to leave almost no clearance between them, the mutually overlaid parts of the portion do not deviate from each other. For that reason, the end portion 422 can be securely held at the attaching portion 419 of the x-axis carriage 404. A compressed spring 424 for controlling the tension of the belt 414 is wound on the other bent-back and folded end portion 423 thereof so that one end 424*a* of the spring is inserted in between the mutually overlaid parts of the portion at the end thereof to prevent the spring from coming off the portion. The end portion 423 is laid through between the other pair of guide juts 420*a* and 420*b* so that the spring 424 is located inside the juts and engaged with the inner sides of the juts at the other end of the spring. For that reason, the end portion 423 can also be securely held at the attaching portion 419 of the carriage 404. Both the bent-back and folded end portions 422 and 423 of the timing belt 414 can thus be securely attached to the attaching portion 419 of the x-axis carriage 404 by the simple work in which the belt is bent back and folded at both the ends thereof, one bent-back and folded end portion 422 of the belt is engaged with the engagement pin 421, the compressed spring 424 is wound on the other bent-back and folded end portion 423 of the belt, and both the end portions are laid through between the pairs of guide juts 420*a* and 420*b*.

The other timing belt 406 can be securely attached at the ends thereof to the y-axis carriage 402 in the same manner as the former timing belt.

Figure 30:
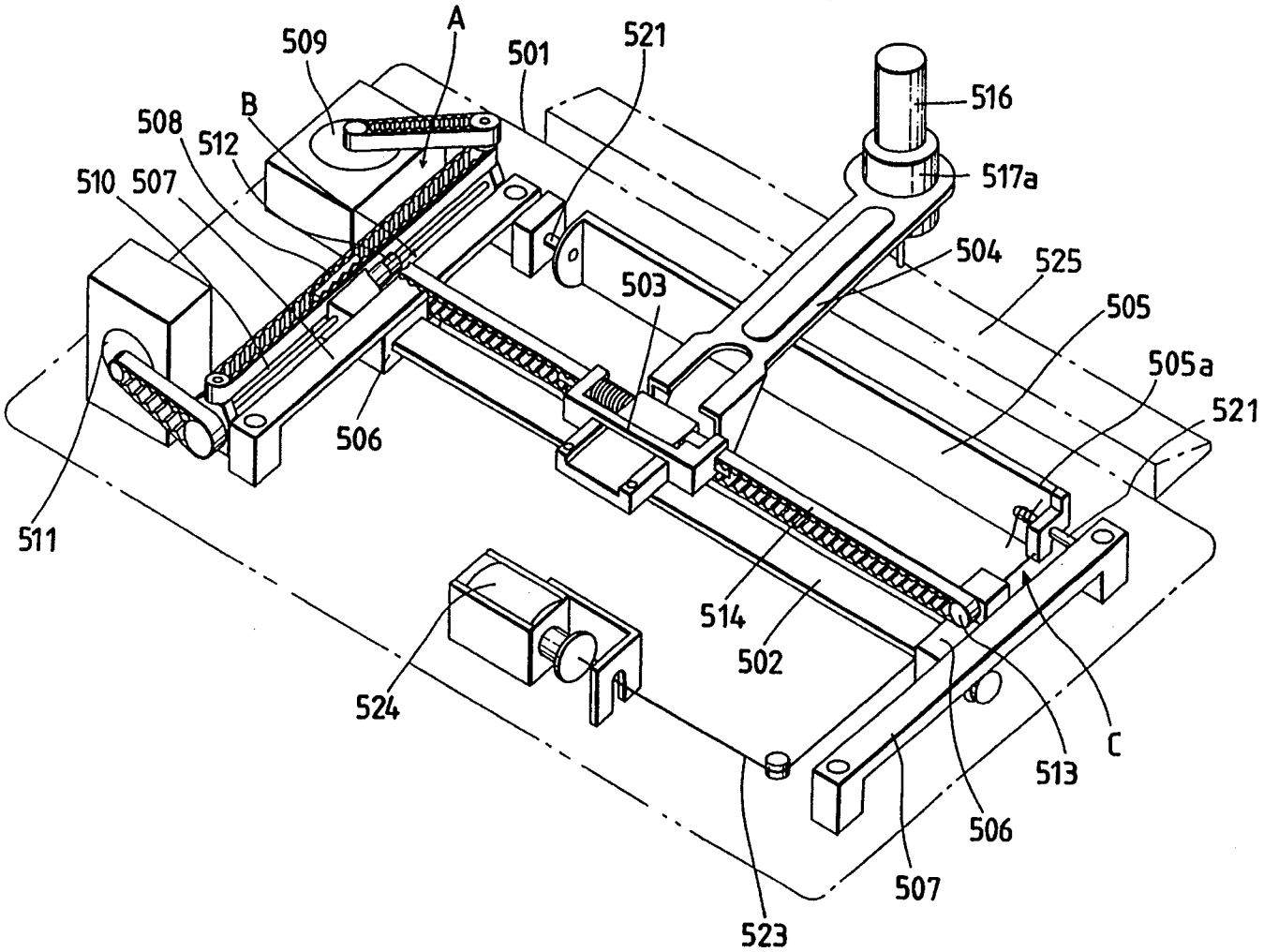
FIG. 30 is a perspective view of a writing apparatus according to a further modification in the embodiments of the present invention.

A further modification in the above-mentioned embodiments of the present device is hereafter described with reference to the drawings attached hereto. The modification is directed to a pen support arm for a writing apparatus as shown in FIG. 30.

The writing apparatus includes an x-axis rail 502 supported by the casing frame 501 so as to be movable relative to the frame along a horizontal y-axis; an x-axis carriage 503 supported by the rail so as to be movable relative to the rail along a horizontal x-axis perpendicular to the x-axis; the pen support arm 504 supported at the butt thereof by the carriage; a pen lifting rail 505 for swinging the arm up and down: y-axis carriages 506 secured to the x-axis rail at both the ends thereof; guide rails 507 extending in parallel with each other along the y-axis; a drive mechanism A for moving the x-axis rail along the y-axis; a drive mechanism B for moving the x-axis carriage along the x-axis; and a drive mechanism C for swinging the pen lifting rail up and down. The x-axis rail 502 is moved with the y-axis carriages 6 on the guide rails 507 along the y-axis.

The drive mechanism A for moving the pen support arm 504 with the x-axis rail 502 along the y-axis is provided on the casing frame 501, and includes the rail, the y-axis carriages 506 secured to the rail and movable along the y-axis, a timing belt 8 extending along the y-axis and coupled to one of the carriages, and a step motor 509 for revolving the belt to move the rail along the y-axis. When the step motor 509 is put in action, the timing belt 508 is revolved to move the y-axis carriages 506 and the x-axis rail 502 together along the y-axis to move the pen support arm 504 along the axis.

The drive mechanism B for moving the pen support arm 504 with the x-axis carriage 503 along the x-axis is provided on the casing frame 501, and includes the carriage, a rotary shaft 510 provided under the timing belt 508 and extending along the y-axis, a step motor 511 connected to the shaft to rotate it to move the carriage along the x-axis, a toothed pulley 512 supported by one of the y-axis carriages 506 so as to be rotatable together with the shaft and slidable thereon, another toothed pulley 513 supported by the other of the y-axis carriages, and a timing belt 514 engaged with both the pulleys and secured to the x-axis carriage. When the step motor 511 is put in action, the rotary shaft 510 is rotated to revolve the timing belt 514 through the action of the toothed pulleys 512 and 513 to move the x-axis carriage 503 along the x-axis to move the pen support arm 504 along the axis.

The step motors 509 and 511 are connected to a controller made of a microcomputer but not shown in the drawings. Commands are sent from the controller in order to rotate the step motors 509 and 511 by prescribed quantities.

Figure 31:
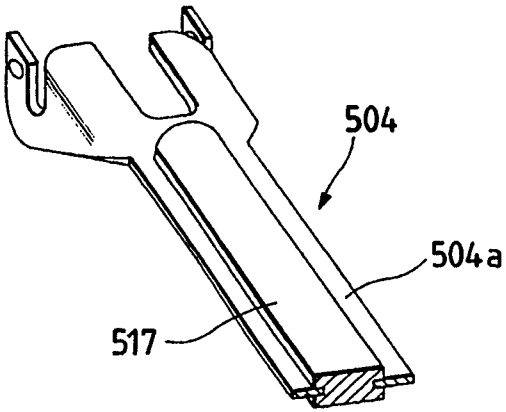
FIG. 31 is a partially-sectional perspective view of a pen support arm.
Figure 32:
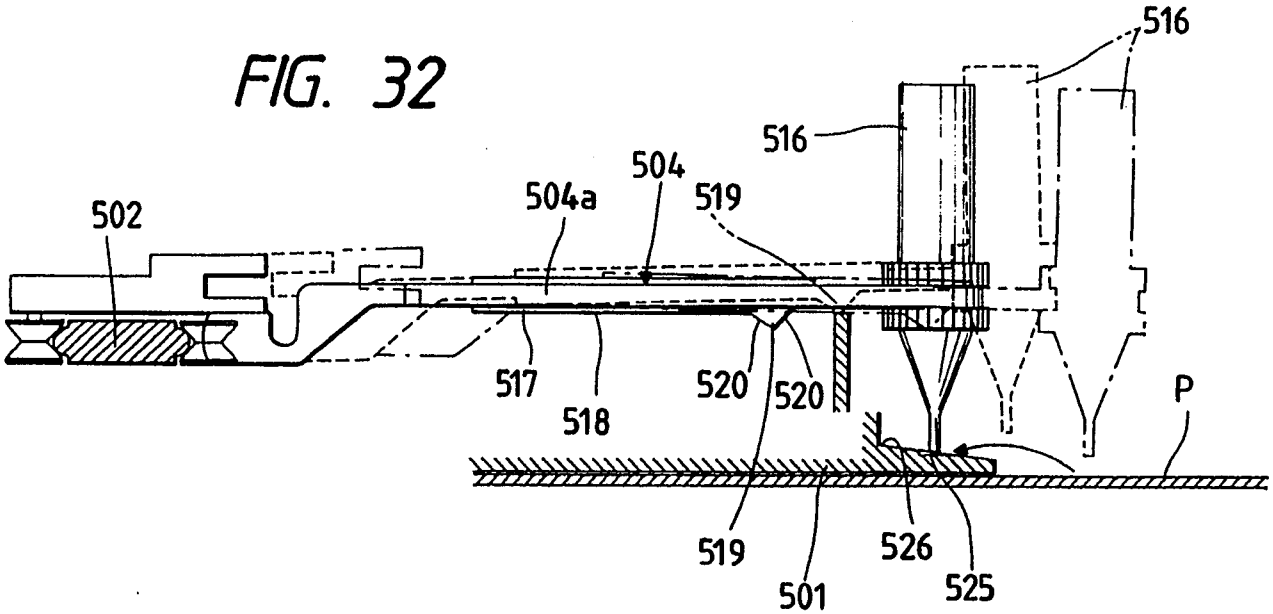
FIG. 32 is a view of the apparatus to illustrate the operation of the arm when the apparatus is out of writing operation.

The pen support arm 504 is supported at the butt thereof with a hinge by the x-axis carried 503 so that the arm can be swung up and down. The arm 504 has a pen holding portion 517*a* at the tip of the arm so that a pen 516 is held in the portion. The arm 504 includes a metal frame 504*a* of high rigidity, and a synthetic resin portion 517 which has the same longitudinal direction as the frame and whose bottom is lower than that of the frame, as shown in FIGS. 31 and 32. The bottom of the synthetic resin portion 517 has a slide contact surface 518, which slides on the pen lifting rail 505 as the arm is moved along each of the x-axis and the y-axis in the writing operation of the apparatus. The bottom of the arm 504 has an upper surface extending between the slide contact surface 518 and the pen holding portion 517*a* and continuous to a wall continuous to the slide contact surface, and has an engagement bump 519 formed at the wall and having a front and a rear guide slopes 520 for guiding the sliding of the arm 504 on the pen lifting rail 505. The synthetic resin portion 517 is made of polycarbonate. The bump 519 is integrally formed on the portion 517.

The pen lifting rail 505 is a slender plate extending near the front edge of the casing frame 501 in parallel with the x-axis rail 502 and supported at the centers of both the end portions of the plate with pins 521 by the frame so that the plate can be swung up and down to make both the main surfaces thereof nearly vertical and horizontal and move one side edge 505*a* of the plate up and down.

Figure 33A:
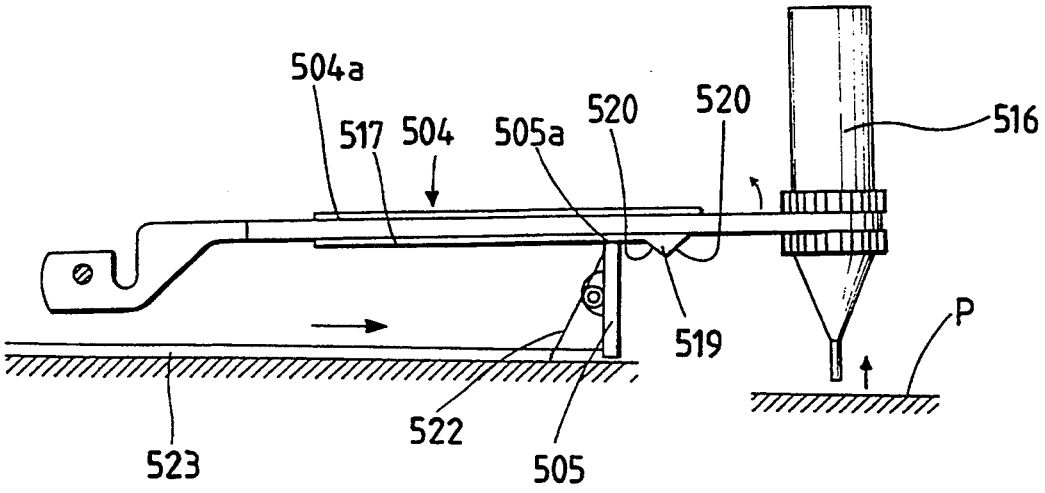
FIGS. 33(*a*) and 33(*b*) are views of the apparatus to illustrate the operation of a pen lifting rail.
Figure 33B:
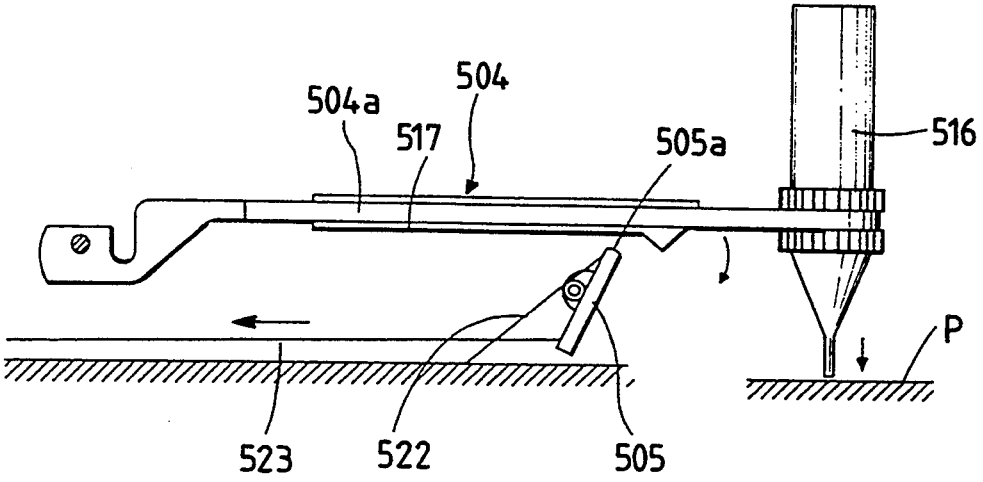

The drive mechanism C for swinging the pen lifting rail 505 up and down to swing the pen support arm 504 up and down includes a helical torsion spring 522 urging the rail at one main surface thereof in such a direction as to normally move up the side edge 505*a* of the rail, a string 523 coupled at one end thereof to the rail at the other side edge 505*b* thereof, and a solenoid 524 to which the string is coupled at the other end thereof. When the solenoid 524 is de-energized, the rail 505 is swung up by the force of the spring 513 to make both the main surfaces of the rail nearly vertical and move up the side edge 505*a* thereof so that the edge comes into contact with the bottom of the pen support arm 504 to move up the pen 510 from the surface P of writing paper, as shown in FIG. 33*a*). When the solenoid 524 is energized, the string 523 is pulled by the solenoid to swing down the rail 505 to make both the main surfaces thereof nearly horizontal and move down the side edge 505*a* of the rail so that the edge comes out of contact with the arm 504 to let it gravitate to move down the pen 510 into contact with the surface P of the writing paper, as shown in FIG. 33(*b*).

When a character, a figure or the like is to be written on the surface P of the writing paper by the writing apparatus, the pen lifting rail 505 is swung down to swing down the pen support arm 504 to move down the pen 516 into contact with the surface of the paper and the pen is then moved along the x-axis and the y-axis to perform a step of writing, and the rail is thereafter swung up to swing up the arm to move up the pen, the pen is then moved along the x-axis and the y-axis with the arm sliding at the slide contact surface 518 of the synthetic resin portion 517 thereon on the rail, the rail is then swung down to swing down the arm to move down the pen into contact with the surface of the paper and the pen is then moved along the axes to perform a next step of writing. A number of such steps of writing are thus performed repeatedly to write the character, the figure or the like on the surface P of the paper. To swing the arm 504 up and down, the rail 505 is swung up and down by de-energizing and energizing the solenoid 524 under the regulatory action of the controller.

When writing is not performed by the apparatus, the pen 516 is put on a pen rest 525 so that ink on the pen is prevented from drying. The pen rest 525 is formed on the middle portion of the front slope 526 of the casing frame 501. To put the pen 516 on the pen rest 525, the solenoid 524 is de-energized to keep the pen lifting rail 505 in the swung-up position thereof, and the pen support arm 504 is moved rearward with the x-axis rail 502 along the y-axis beyond the range of writing movement thereof so that the slide contact surface 518 of the synthetic resin portion 517 of the arm slides on the pen lifting rail, and the guide slopes 520 of the engagement bump 519 of the arm then slide on the lifting rail to guide the arm to move it up to move the pen over the front slope 526 of the casing frame 501, as shown in FIG. 32. After the engagement bump 519 has moved beyond the rail 505, the pen 516 slides on the slope 526 so that the pen reaches the pen rest 525. At that time, the upper surface of the bottom of the arm 504 faces the rail 505 across a small gap so that the tip of the pen 516 comes into good tight contact with the pen rest 525 due to the weight of the pen.

The pen support arm 504 has the metal frame 504*a* which makes the rigidity of the arm high enough as a whole. Besides, the arm 504 can be manipulated to put the pen 516 on the pen rest 525 to keep the tip of the pen out of contact with air to prevent the ink on the tip from drying as the apparatus is out of writing operation. At that time, the pen lifting rail 505 is kept in the swung-up position thereof, and the solenoid 524 remains de-energized not to consume electricity unnecessarily. Since the synthetic resin portion 517 and the engagement bump 519 are integrally formed together, it is not necessary to take time and trouble in particular to provide such a bump.

To put the apparatus in writing operation again after the pen 516 is kept on the rest 525, the pen support arm 504 is moved forward with the x-axis rail 502 along the y-axis so that the pen is put out of contact with the rest, the synthetic resin portion 517 of the arm slides on the pen lifting rail 505, and the pen is moved to a location over the surface P of the writing paper to resume writing.

The portion of the arm 504, which is located between the slide contact surface 518 and the engagement bump 519, may be made of a synthetic resin as well as them.

The foregoing description of preferred embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A writing apparatus comprising:

an x-axis rail (2) supported by a casing frame (1) so as to be movable relative to said frame (1) along a horizontal y-axis;

an x-axis carriage (3) supported by said x-axis rail (2) so as to be movable relative to said x-axis rail (2) along a horizontal x-axis perpendicular to said y-axis;

a pen support arm (4), having a tip and a butt, for supporting a pen (10) at the tip thereof, said pen support arm (4) being supported at the butt thereof by said carriage (3) so as to be swingable up and down;

a pen lifting rail (5) extending in parallel with said x-axis rail (2) and supported so as to be capable of being swung into contact with the bottom of said arm (4) to move said pen (10) up from the surface of writing medium and being swung down out of contact with said bottom to let said pen (10) fall into contact with the surface of said writing medium:

an urging means (13) for always urging said pen lifting rail (5) in a direction in which said pen lifting rail (5) is swung up; and means (15) for reducing an impact noise between said pen lifting rail (5) and said arm (4), wherein said impact noise reducing means (15) comprises a solenoid (15) energized to swing down said pen lifting rail (5), wherein immediately before said pen lifting rail (5) being swung up by de-energizing said solenoid (15) comes into contact with the bottom of said arm (4), said solenoid (15) is instantaneously energized to slow down the upward swinging of said lifting rail (5).

2. An apparatus according to claim 1, wherein said solenoid (15) is supplied with a constant electrical current despite the fluctuation in the voltage of a power supply for said solenoid (15).

3. A writing apparatus comprising:

an x-axis rail (2) supported by a casing frame (1) so as to be movable relative to said frame (1) along a horizontal y-axis;

an x-axis carriage (3) supported by said x-axis rail (2) so as to be movable relative to said x-axis rail (2) along a horizontal x-axis perpendicular to said y-axis;

a pen support arm (4), having a tip and a butt, for supporting a pen (10) at the tip thereof said pen support arm (4) being supported at the butt thereof by said carriage (3) so as to be swingable up and down;

a pen lifting rail (5) extending in parallel with said x-axis rail (2) and supported so as to be capable of being swung into contact with the bottom of said arm (4) to move said pen (10) up from the surface of writing medium and being swung down out of contact with said bottom to let said pen (10) fall into contact with the surface of said writing medium;

an urging means (13) for always urging said pen lifting rail (5) in a direction in which said pen lifting rail (5) is swung up;

means (15) for reducing an impact noise between said pen lifting rail (5) and said arm (4), wherein said impact noise reducing means (15) comprises a solenoid (15) energized to swing down said pen lifting rail (5); and means for modulating the time, quantity and duration of instantaneous energizing of said solenoid (15) according to at least one of a location of said pen (4) and said x-axis rail (2) along the y-axis.

4. An apparatus according to claim 3, wherein said solenoid (15) is supplied with an constant electrical current despite the fluctuation in the voltage of a power supply for said solenoid (15).

5. A writing apparatus comprising:

an x-axis rail (2) supported by a Casing frame (1) so as to be movable relative to said frame (1) along a horizontal y-axis;

an x-axis carriage (3) supported by said x-axis rail (2) so as to be movable relative to said x-axis rail (2) along a horizontal x-axis perpendicular to said y-axis;

a pen support arm (4), having a tip and a butt, for supporting a pen (10) at the tip thereof, said pen support arm (4) being supported at the butt thereof by said carriage (3) so as to be swingable up and down;

a pen lifting rail (5) extending in parallel with said x-axis rail (2) and supported so as to be capable of being swung into contact with the bottom of said arm (4) to move said pen (10) up from the surface of writing medium and being swung down out of contact with said bottom to let said pen (10) fall into contact with the surface of said writing medium;

an urging means (13) for always urging said pen lifting rail (5) in a direction in which said pen lifting rail (5) is swung up, wherein said urging means (13) comprises:

a spring (13) which is engaged at one end thereof with said lifting rail (5) and at the other end of said spring (13) with an engagement portion provided on said frame (1); and a means for modulating at least one of the location of the engaged end of said spring (13) on said lifting rail (5) and said engagement portion in the longitudinal direction of said spring; and means (15) for reducing an impact noise between said pen lifting rail (5) and said arm (4).

6. A writing apparatus comprising:

an x-axis rail (2) supported by a casing frame (1) so as to be movable relative to said frame along a horizontal y-axis;

an x-axis carriage (3) supported by said x-axis rail (2) so as to be movable relative to said rail (2) along a horizontal x-axis perpendicular to said y-axis;

a pen support arm (4) having a tip and butt which is supported at the butt thereof by said carriage (3) so as to be swingable up and down, and supports a pen (10) at the tip of said arm (4);

a pen lifting rail (5) which extends in parallel with said x-axis rail (2) and which is supported so as to be capable of being swung up into contact with the bottom of said arm (4) to move said pen (10) up from the surface of writing paper and swung down out of contact with said bottom to let said pen (10) fall into contact with the surface of said paper;

urging means (13) for always urging said pen lifting rail (5) in a direction in which said pen lifting rail (5) is swung up; and a solenoid (15) which is energized to swing down said pen lifting rail (5), wherein the time, quantity and duration of the energizing of said solenoid (15), which is performed to swing down said lifting rail (5) after said solenoid (15) is de-energized to swing up said lifting rail (5), are modulated depending on the location of said pen (10) or said x-axis rail (2) along said y-axis.

7. An apparatus according to claim 6, wherein said solenoid (15) is supplied with an electrical current constant despite the fluctuation in the voltage of a power supply for said solenoid (15).

8. A writing apparatus according to claim 6, in which said solenoid (15) is energized to swing down said pen lifting rail (5), wherein immediately before said pen lifting rail (5) being swung up by de-energizing said solenoid (15) comes into contact with the bottom of said arm (4), said solenoid (15) is instantaneously energized to slow down the upward swinging of said lifting rail (5).

9. An apparatus according to claim 6, wherein said urging means (13) comprises:

a spring (13) which is engaged at one end thereof with said lifting rail (5) and at the other end of said spring (13) with an engagement portion provided on said frame (1); and a means for modulating at least one of the location of the engaged end of said spring (13) on said lifting rail (5) and said engagement portion in the longitudinal direction of said spring.

10. A writing apparatus comprising:

an x-axis rail (202) supported at both ends thereof by a pair of y-axis carriages (207) which are simultaneously moved relative to a casing frame (201) along a horizontal y-axis;

an x-axis carriage (203) supported by said x-axis rail (202) so as to be movable relative to said rail (202) along a horizontal x-axis perpendicular to said y-axis;

a set of y-axis rails (206) provided on said frame (201) near the right and left ends of said x-axis rails, said rack (206) rails extending along said y-axis, wherein the racks of said rack rails (206) are confronted with the upper surface of said casing frame (201);

pinions (310) with teeth provided at the right and left ends of said x-axis rail (202) and engaged with said rack rails (206) so that said pinions (310) roll thereon in conjunction with other, wherein the teeth of each of the pinions (310) are constituted by a series of teeth and another series of teeth having a positional difference of half pitch from the former; and the teeth of each of the racks of the rack rails (206) are constituted by a series of teeth and another series of teeth having a positional difference of half pitch from the former, correspondingly to said pinion;

a pen support arm (204), having a tip and butt, which is supported at the butt thereof by said x-axis carriage (203) so as to be swingable up and down, and supports a pen (210) at the tip of said arm (204);

a pen lifting rail (205) which extends in parallel with said x-axis rail (202) and which is supported to be capable of being swung up into contact with the bottom of said arm (204) to move said pen up from the surface of writing paper and swung down out of contact with said bottom to let said pen (10) fall into contact with the surface, said pen lifting rail (205) being supported at both ends thereof in a swingable manner by said y-axis carriages (207) or members coupled thereto;

urging means for always urging said pen lifting rail (205) in a direction in which said pen lifting rail (205) is swung up;

a solenoid (215) which is energized to swing down said pen lifting rail (205);

means (216, 218) for moving said y-axis carriages (207) along said y-axis;

means (221, 224) for moving said x-axis carriage (203) along said x-axis;

a jut (213) for moving said pen support arm (204) up and down, said jut extending out away from one end of said lifting rail (205) along said x-axis and being located away from the axis of the swinging of said lifting rail (205): and operating means (214) swingable up and down for moving said jut up and down, said operating member being supported by said frame (201) and extending along the total length of the movement of said x-axis rail (202) along said y-axis (207).

11. A writing apparatus according to claim 10, further comprises:

means for attaching a timing belt (414) at the ends thereof to at least one of said y-axis carriage (402) and said x-axis carriage (404);

wherein said y-axis carriage or said x-axis carriage has an attaching portion to which said belt having bent-back and folded end portion (414) is attached at the ends thereof; said portion has pairs of upper and lower guide juts (420*a*, 420*b*) located at both the ends of said portion and extending rectangularly across the longitudinal direction of said belt so that the distance between said juts (420*a*, 420*b*) of each pair is nearly equal to the thickness of each bent-back and folded end portion (423) of said belt (414), which is formed by bending said belt back and then folding it at the end thereof; said attaching portion (420*a*, 420*b*) also has an engagement pin (421) located inside one of said pairs of upper and lower guide juts and extending along them; both the bent-back and folded end portions (423) of said belt are laid through between said pairs of upper and lower guide juts (420*a*, 420*b*), respectively; one of said end portions is engaged with said pin (421); and a compressed spring (424) for controlling the tension of said belt (414) is wound on the other of said end portions, located inside the other of said pairs of upper and lower guide juts (420*a*, 420*b*), and engaged with the inner sides thereof at the end of said spring (424).

12. A writing apparatus according to claim 10, wherein said arm (504) can be moved over a prescribed area of said casing frame (501) along said horizontal x-axis and said horizontal y-axis perpendicular to each other, and a pen rest (525) provided in front of said rail so that the tip of said pen (516) is put on said rest when said apparatus is out of writing operation in which said arm (504) is made of a metal frame (504*a*), and a synthetic resin portion (517) which extends in the same longitudinal direction as said metal frame (504*a*) and whose bottom is lower than that of said metal frame;

said resin portion (517) has a slide contact surface which slides on said rail (505) at least when said apparatus is in writing operation; the bottom of said arm (504) has an upper surface between said slide contact surface and said pen holding portion so that said upper surface is continuous to a wall which is continuous to said slide contact surface, and said upper surface faces said rail across a gap when said pen is moved to said rest as said apparatus is out of writing operation; and said arm has an engagement bump (519) formed at said wall so as to be engaged with said rail to guide said arm to move it up.

13. A writing apparatus comprising:

an x-axis rail (302) supported by a casing frame (301) so as to be movable relative to said frame (301) along a horizontal y-axis:

an x-axis carriage (303) supported by said rail (302) so as to be movable relative to said rail along a horizontal x-axis perpendicular to said y-axis;

a pen support arm (305), having a tip and butt, supported at the butt thereof by said carriage (303) and holding a pen (304) at the tip of said arm (305);

rack rails (306) provided on said frame (301) near the right and left ends of said x-axis rails (302), and extend along said y-axis, wherein the racks of said rack rails (306) are confronted with the upper surface of said casing frame (301); and pinions (310) with teeth provided at the right and left ends of said x-axis rail (302) and engaged with said rack rails (306) so that said pinions (310) roll thereon in conjunction with each other, wherein the teeth of each of the pinions (310) constituted by a series of teeth and another series of teeth having a positional difference of half pitch from the former and the teeth of each of the racks of said rack rails (306) are constituted by a series of teeth and another series or teeth having a positional difference of half pitch from the former, correspondingly to said pinion.

14. A writing apparatus according to claim 13, further comprising:

a pair of y-axis carriages (207) supporting both ends of said x-axis rail (202), said y-axis carriages (207) being simultaneously moved relative to a casing frame (201) along a horizontal y-axis;

a pen lifting rail (205) which extends in parallel with said x-axis rail (202) and which is supported to be capable of being swung up into contact with the bottom of said arm (204) to move said pen up from the surface of writing paper and swung down out of contact with said bottom to let said pen (210) fall into contact with the surface, said pen lifting rail (205) being supported at both the ends thereof in a swingable manner by said y-axis carriages (207) or members coupled thereto;

urging means for always urging said pen lifting rail (205) in a direction in which said pen lifting rail (205) is swung up;

a solenoid (215) which is energized to swing down said pen lifting rail (205);

means (216, 218) for moving said y-axis carriages (207) along said y-axis;

means (221, 224) for moving said x-axis carriage (203) along said x-axis;

a jut (213) for moving said pen support arm (204) up and down, said jut extending out away from one end of said lifting rail (205) along said x-axis and being located away from the axis of the swinging of said lifting rail (205); and an operating means (214) swingable up and down for moving said jut up and down, said operating member being supported by said frame (201) and extending along the total length of the movement of said x-axis rail (202) along said y-axis (207).

15. A writing apparatus according to claim 13, further comprises:

means for attaching a timing belt (414) having bent-back and folded end portions at the ends thereof to at least one of a y-axis carriage and said x-axis carriage;

wherein said y-axis carriage or said x-axis carriage has an attaching portion to which said belt is attached at the ends thereof; said portion has pairs of upper and lower guide juts (420*a*, 420*b*) located at both the ends of said portion and extending rectangularly across the longitudinal direction of said belt so that the distance between said juts (420*a*, 420*b*) of each pair is nearly equal to the thickness of each bent-back and folded end portion (423) of said belt (414), which is formed by bending said belt back and then folding it at the end thereof; said attaching portion (420*a*, 420*b*) also has an engagement pin (421) located inside one of said pairs of upper and lower guide juts and extending along them; both the bent-back and folded end portions (423) of said belt are laid through between said pairs of upper and lower guide juts (420*a*, 420*b*), respectively; one of said end portions is engaged with said pin (421); and a compressed spring (424) for controlling the tension of said belt (414) is wound on the other of said end portions, located inside the other of said pairs of upper and lower guide juts (420*a*, 420*b*), and engaged with the inner sides thereof at the end of said spring (424).

16. A writing apparatus according to claim 13, wherein said arm (504) can be moved over a prescribed area of said casing frame (501) along said horizontal x-axis and said horizontal y-axis perpendicular to each other, and a pen rest (525) provided in front of said rail so that the tip of said pen (516) is put on said rest when said apparatus is out of writing operation in which said arm (504) is made of a metal frame (504*a*), and a synthetic resin portion (517) which extends in the same longitudinal direction as said metal frame (504*a*) and whose bottom is lower than that of said metal frame; said resin portion (517) has a slide contact surface which slides on said rail (505) at least when said apparatus is in writing operation; the bottom of said arm (504) has an upper surface between said slide contact surface and said pen holding portion so that said upper surface is continuous to a wall which is continuous to said slide contact surface, and said upper surface faces said rail across a gap when said pen is moved to said rest as said apparatus is out of writing operation; and said arm has an engagement bump (519) formed at said wall so as to be engaged with said rail to guide said arm to move it up.

17. A method of reducing an impact noise on a writing apparatus including an x-axis rail supported by a casing frame so as to be movable relative to said frame along a horizontal y-axis; an x-axis carriage supported by said rail so as to be movable relative to said rail along a horizontal x-axis perpendicular to said y-axis; a pen support arm which is supported at the butt thereof by said carriage so as to be swingable up and down and supports a pen at the tip of said arm; a pen lifting rail which extends in parallel with the former rail and which is supported so as to be capable of being swung up into contact with the bottom of said arm to move said pen up from the surface of writing paper and swung down out of contact with said bottom to let said pen fall into contact with the surface of said paper, and is always urged in such a direction as to be swung up; and a solenoid which is energized to swing down said pen lifting rail, comprising the steps of:

instantaneously energing said solenoid to slow down the upward swinging of said lifting rail immediately before said pen lifting rail being swung up by de-energizing said solenoid comes into contact with the bottom of said arm.

18. A method according to the claim 17, further comprising the steps of:

modulating the time, quantity and duration of the instantaneous energizing of the solenoid depending on the location of the pen or the x-axis rail along the y-axis.

19. A method of moving down the pen of a writing apparatus including an X-axis rail supported by a casing frame so as to be movable relative to said frame along a horizontal y-axis; an x-axis carriage supported by said rail so as to be movable relative to said rail along a horizontal x-axis perpendicular to said y-axis; a pen support arm which is supported at the butt thereof by said carriage so as to be swingable up and down, and supports said pen at the tip of said arm; a pen lifting rail which extends in parallel with said x-axis rail and which is supported so as to be capable of being swung up into contact with the bottom of said arm to move up said pen from the surface of writing paper and swung down out of contact with said bottom to let said pen fall into contact with the surface of said paper, and is always urged in such a direction as to be swung up; and a solenoid which is energized to swing down said pen lifting rail, comprising the steps of:

modulating the time, quantity and duration of the energizing of said solenoid, which is performed to swing down said lifting rail after said solenoid is de-energized to swing up said lifting rail, depending on the location of said pen or said x-axis rail along said y-axis.

20. A method according to the claim 19, in which the solenoid is supplied with an electrical current constant despite the fluctuation in the voltage of a power supply for said solenoid.

* * * * *